US007587156B2

(12) United States Patent
Kato et al.

(10) Patent No.: US 7,587,156 B2
(45) Date of Patent: Sep. 8, 2009

(54) REPLACEABLE PROCESS CARTRIDGE AND IMAGE FORMING APPARATUS USING THE SAME

(75) Inventors: Shinichi Kato, Tokyo (JP); Yasuhiro Kuba, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 179 days.

(21) Appl. No.: 11/763,503

(22) Filed: Jun. 15, 2007

(65) Prior Publication Data

US 2008/0008497 A1 Jan. 10, 2008

(30) Foreign Application Priority Data

Jun. 16, 2006 (JP) ..... 2006-167660

(51) Int. Cl.
*G03G 21/18* (2006.01)

(52) U.S. Cl. ..... 399/113

(58) Field of Classification Search ..... 399/113, 399/111, 110, 119, 120
See application file for complete search history.

(56) References Cited

U.S. PATENT DOCUMENTS

| | | | | |
|---|---|---|---|---|
| 5,153,640 | A * | 10/1992 | Okabe | 399/113 |
| 5,854,955 | A * | 12/1998 | Yawata et al. | 399/111 |
| 6,289,194 | B1 * | 9/2001 | Endo et al. | 399/113 X |
| 6,980,759 | B2 * | 12/2005 | Kanno et al. | 399/111 |
| 7,221,888 | B2 * | 5/2007 | Hymas et al. | 399/111 |
| 7,463,844 | B2 * | 12/2008 | Hashimoto et al. | 399/111 |
| 2006/0159487 | A1 * | 7/2006 | Choi et al. | 399/113 |
| 2006/0216061 | A1 * | 9/2006 | Yamaguchi | 399/111 |
| 2006/0245785 | A1 * | 11/2006 | Kawamura et al. | 399/111 |

FOREIGN PATENT DOCUMENTS

| | | |
|---|---|---|
| JP | 07-162568 | 6/1995 |
| JP | 08-286508 | 11/1996 |
| JP | 08-328368 | 12/1996 |
| JP | 09-120251 | 5/1997 |
| JP | 2000-172151 | 6/2000 |
| JP | 2001-066970 | 3/2001 |
| JP | 2002-108174 | 4/2002 |
| JP | 2002-214900 | 7/2002 |
| JP | 2005-188993 | 7/2005 |
| JP | 2005-215629 | 8/2005 |

OTHER PUBLICATIONS

U.S. Appl. No. 12/264,592, filed Nov. 4, 2008, Kuba.

* cited by examiner

*Primary Examiner*—Sophia S Chen
(74) *Attorney, Agent, or Firm*—Oblon, Spivak, McClelland, Maier & Neustadt, P.C.

(57) ABSTRACT

A process cartridge for use in an image forming apparatus includes a first unit, a second unit, and a coupling shaft. The first unit includes an image carrier, while the second unit includes a developer carrier. The coupling shaft is configured to couple the first unit and the second unit so as to be pivotable relative to each other. A distance between the image carrier and the developer carrier is adjustable by pivoting at least one of the first unit and the second unit without releasing the coupling of the first unit and the second unit via the coupling shaft.

19 Claims, 22 Drawing Sheets

REPLACEABLE PROCESS CARTRIDGE AND IMAGE FORMING APPARATUS USING THE SAME

CROSS REFERENCE TO RELATED APPLICATIONS

This patent specification is based on Japanese patent application, No. JP 2006-167660 filed on Jun. 16, 2006 in the Japan Patent Office, the entire contents of which are incorporated by reference herein.

BACKGROUND OF THE INVENTION

1. Field of the Invention

The present invention relates to a process cartridge and an image forming apparatus using the same, and more particularly to an effectively replaceable process cartridge and an image forming apparatus using the same.

2. Discussion of the Background

Image forming apparatuses include copiers, facsimiles, printers, plotters, multi-functional devices thereof, etc. Some image forming apparatuses may use an electrophotographic method to form an image on a recording medium. Such image forming apparatuses include a plurality of components such as a photoconductor drum, a developing roller, a charger, a cleaner, etc.

In consideration of size reduction or ease of maintenance, some image forming apparatuses are provided with a process cartridge for visualizing an electrostatic latent image on an image carrier with developer including toner. The process cartridge includes a plurality of components, and is configured to be detachably mountable to an image forming apparatus.

Such a process cartridge may be configured with a plurality of units. For example, a process cartridge may include a first unit having an image carrier, and a second unit having a developer carrier, which may be rotatably coupled to each other with a coupling member.

A process cartridge having such a configuration includes a photoconductor unit as the first unit and a developing unit as the second unit. The photoconductor unit also includes a photoconductor drum serving as an image carrier, while the developing unit includes a developing roller serving as a developer carrier. A coupling member for coupling the two units is disposed at a position in a direction in which an engaging pressure is applied between gears of the photoconductor drum and the developing roller. The coupling member is also supported so as to be movable along a direction perpendicular to the engaging pressure direction.

Thus, during driving of the photoconductor drum, the coupling member is positioned so as not to generate a rotational moment for unintentionally rotating the developing unit. Thereby the pressing force of the developing roller may be stably applied to the photoconductor drum to form a desired image.

Another conventional process cartridge having two units includes coupling pins for coupling the two units with each other. The two units are coupled so as to pivot around the coupling pins. The coupling pins are configured to project toward the outside of the process cartridge along the longitudinal direction of the two units.

Guide grooves are provided on an image forming apparatus using the process cartridge. When the process cartridge is mounted to or detached from the image forming apparatus, the coupling pins are put into or pulled out of the image forming apparatus along the guide groove.

For such a process cartridge, to reduce operating costs or environmental load, separate replacement of components is increasingly preferred to the whole replacement of the process cartridge as conventionally performed. Therefore a need exists for a process cartridge including replaceable components that are quick and easy to reuse.

However, a conventional process cartridge does not take sufficient consideration of the operability of components during disassembly and assembly thereof. For example, a process cartridge including coupling pins as described can be disassembled by clipping the end faces of the coupling pins with a tool. However, after disassembly, some time and effort are needed for re-inserting the coupling pins to reassemble the process cartridge.

In an image forming apparatus using a process cartridge as described above, a developing gap is formed between an image carrier and a developer carrier.

In a method of measuring such a developing gap, first, a measuring device is inserted into the developing gap, and a filling material stored in the measuring device is filled into and drawn from the developing gap. At this time, a portion of the measuring device expands and shrinks in the developing gap. The portion is provided with flat plates on both end surfaces thereof. The flat plates are brought into contact with both walls of the developing gap. Then the developing gap is measured with a detector of the measuring device.

In another method of measuring the developing gap, the developing gap is determined based on the width of a transmitting light flux measured by an optical dimension measuring device.

However, for the developing gap as described above, adjusting methods thereof are not sufficiently described compared to the measuring methods.

SUMMARY OF THE INVENTION

This patent specification describes a replaceable process cartridge and an image forming apparatus using the same. In an example of a preferred embodiment of the present invention, a process cartridge for use in an image forming apparatus includes a first unit, a second unit, and a coupling shaft. The first unit includes an image carrier, while the second unit includes a developer carrier. The coupling shaft is configured to couple the first unit and the second unit so as to be pivotable relative to each other. A distance between the image carrier and the developer carrier is adjustable by pivoting at least one of the first unit and the second unit without releasing the coupling of the first unit and the second unit via the coupling shaft.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
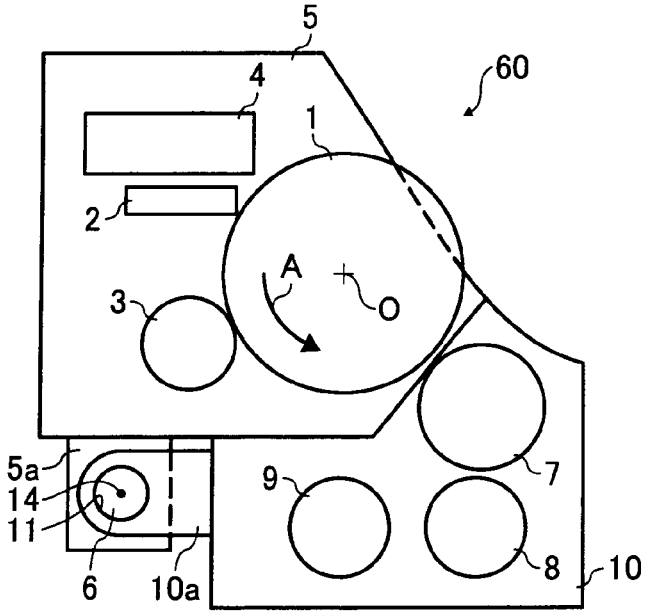
FIG. 1 is a front view illustrating a folded state of a process cartridge according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF THE PREFERRED EMBODIMENTS

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a process cartridge 60 according to an example embodiment of the present invention is described.

As illustrated in FIG. 1, the process cartridge 60 includes a photoconductor drum 1, a photoconductor cleaner 2, a charger 3, a waste toner container 4, first support members 5*a*, hinge pins 6, a developing roller 7, a developer transporter 8, a toner supplying agitator 9, and second support members 10*a*.

The photoconductor drum 1 is surrounded by the charger 3, the developing roller 7, and the photoconductor cleaner 2 along a rotational direction thereof indicated by an arrow A in FIG. 1. The waste toner container 4 is disposed near the photoconductor cleaner 2.

The photoconductor drum 1 serves as an image carrier. A surface portion of the photoconductor drum 1 between the charger 3 and the developing roller 7 serves as an exposed portion to be irradiated by light. Another surface portion of the photoconductor drum 1 between the developing roller 7 and the photoconductor cleaner 2 serves as a transfer section together with a transfer unit (not illustrated). At the transfer section, the image forming apparatus 100 transfers a toner image, which is carried on the photoconductor drum 2, onto a sheet medium.

The process cartridge 60 includes a drum unit 5 and a developing unit 10. In an embodiment of the present invention, the drum unit 5 is a first unit of the process cartridge 60, while the developing unit 10 is a second unit thereof. Alternatively, the developing unit 10 may be a first unit of the process cartridge 60, while the drum unit 5 may be a second unit thereof.

The drum unit 5 may include the photoconductor drum 1, the photoconductor cleaner 2, the charger 3, and the waste toner container 4. In such a configuration, the photoconductor drum 1, the photoconductor cleaner 2, the charger 3, and the waste toner container 4 are attached to a frame of the drum unit 5.

The developing unit 10 includes the developing roller 7, the developer transporter 8, and the toner supply agitator 9. In such a configuration, the developing roller 7, the developer transporter 8, and the toner supply agitator 9 are attached to a frame of the developing unit 10.

The developing roller 7 serves as a developer carrier. The developer transporter 8 includes a conveying screw for conveying a developer containing toner to the developing roller 7. The toner supply agitator 9 includes another conveying screw for conveying and agitating toner and carrier particles.

In FIG. 1, the photoconductor drum 1 has an axis O extending along a longitudinal direction thereof. The axis O of the photoconductor drum 1 is disposed so as to be parallel with the axis of the developing roller 7.

The hinge pins 6 are provided so as to be parallel with the axis O. Each hinge pin 6 serves as a common shaft for coupling the drum unit 5 and the developing unit 10.

The first support members 5*a* protrude from the drum unit 5, while the second support members 10*a* protrude from the developer unit 7. Each of the first support members 5*a* and the second support members 10*a* has an engaging hole 11. The hinge pins 6 are inserted into the corresponding engaging holes 11 of the first support members 5*a* and the second support members 10*a* along a direction being parallel with the axis O of the photoconductor drum 1. Thereby the first support member 5*a* and the second support member 10*a* are engaged with and supported by the hinge pins 6.

Thus the drum unit 5 and the developer unit 10 are pivotably coupled with each other by the hinge pins 6 to integrally form the process cartridge 60. The central axis 14 of each hinge pin 6 is set to a position so that the frames of the photoconductive unit 5 and the developing unit 10 do not interfere with each other when the photoconductor drum 1 and the developing roller 7 pivot in a direction moving away from each other.

As described above, in an embodiment of the present invention, the drum unit 5 and the developing unit 10 is coupled via the two sets of the hinge pins 6, the first support members 5*a*, and the second support members 10*a*. However, the drum unit 5 and the developing unit 10 may be also coupled via one set of the hinge pin 6, the first support member 5*a*, and the second support member 10*a*. Alternatively, the drum unit 5 and the developing unit 10 may be coupled via three or more sets of the hinge pin 6, the first support member 5*a*, and the second support member 10*a*.

Figure 2:
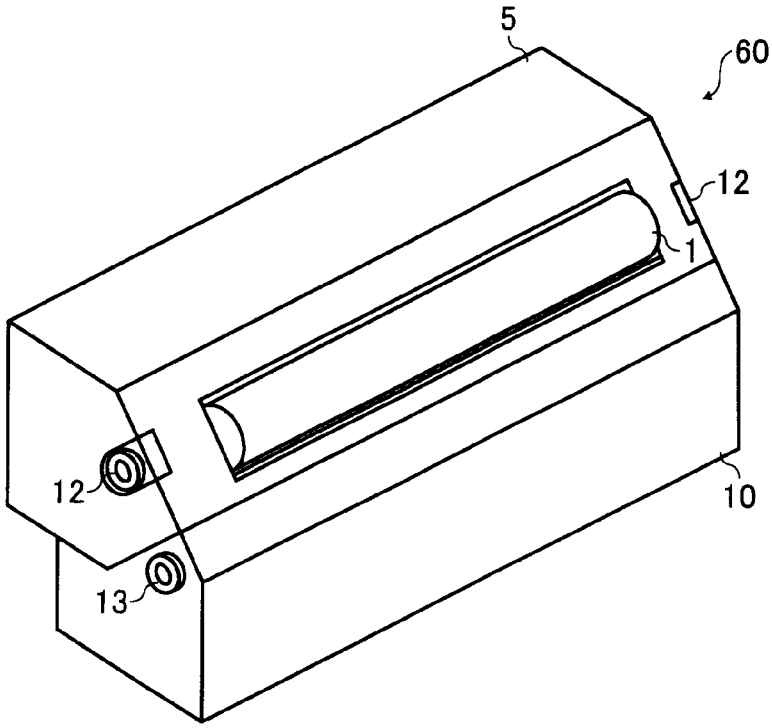
FIG. 2 is a perspective view illustrating a folded state of the process cartridge of FIG. 1.

As illustrated in FIG. 2, a bearing 12 is provided to an end face of the drum unit 5. Although not illustrated in FIG. 2, another bearing 12 is provided on the opposite end surface of the drum unit 5. The photoconductor drum 1 is held in the drum unit 5 via the bearings 12 so the photoconductor drum 1 can rotate smoothly.

Similarly, the developing roller 7 is held in the developing unit 10 via bearings 13, which are provided to end faces of the developing unit 10. Thus, the developing roller 7 is smoothly rotatable in the developing unit 10. Accordingly, the process cartridge 60 can suppress an accidental drop or a positional shift of the photoconductor drum 1 and the developing roller 7.

Figure 3:
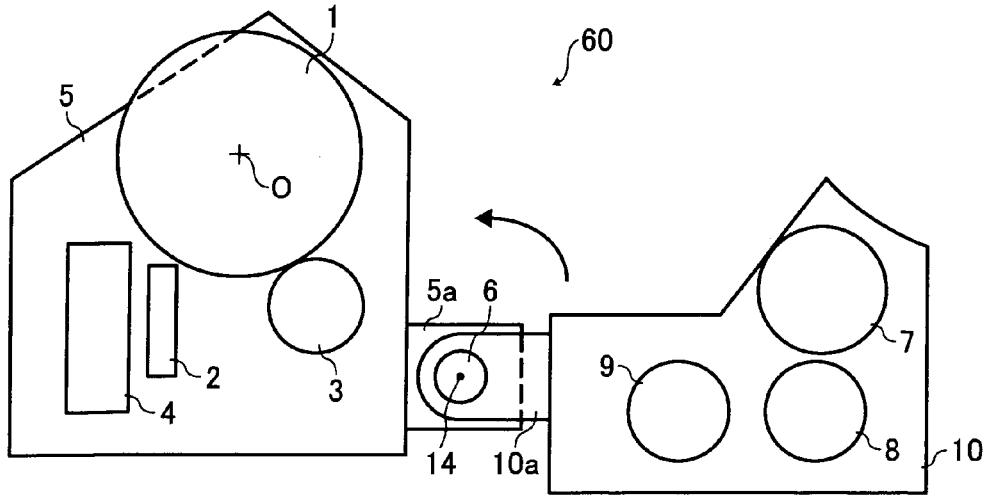
FIG. 3 is a front view illustrating an unfolded state of the process cartridge of FIG. 1.
Figure 4:
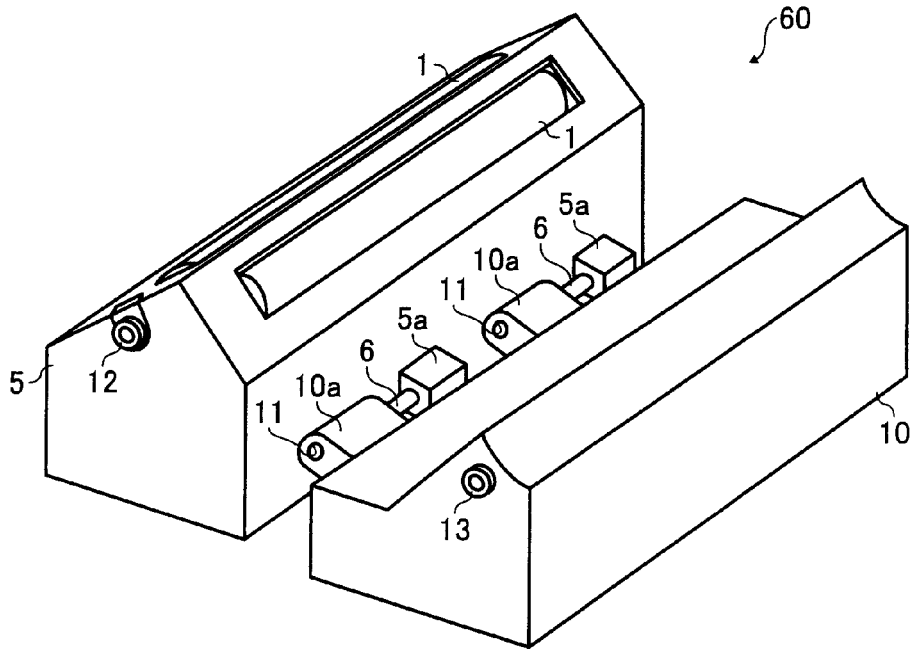
FIG. 4 is a perspective view illustrating an unfolded state of the process cartridge of FIG. 1.

FIGS. 3 and 4 illustrate unfolded states of the process cartridge 60 of FIGS. 1 and 2, respectively. In the unfolded states, the upper side of the photoconductor drum 1 is exposed to the outside. Thus, replacement and maintenance operations of the photoconductor drum 1 can be facilitated.

Similarly, in the unfolded states as illustrated in FIGS. 3 and 4, the upper side of the developing unit 10 is also exposed to the outside. Thus, replacement and maintenance operations of the developing roller 7, the developer transporter 8, and the toner supply agitator 9 can be facilitated.

After finishing such a replacement or maintenance operation of the components of the process cartridge 60, the process cartridge 60 is re-installed in an image forming apparatus. The drum unit 5 and the developing unit 10 are pivoted around the hinge pins 6 so as to come close to each other. Thereby the process cartridge 60 returns to the folded state, as illustrated in FIGS. 1 and 2, in which the photoconductor drum 1, the developing roller 7, and the other components are operably positioned. Thus, the photoconductor drum 1 and the developing roller 7 can be positioned adjacent to each other.

Further, when needed, the process cartridge 60 can be ejected from the image forming apparatus and returned to the unfolded state as illustrated in FIG. 3 or 4. In such an unfolded state, the upper side of the process cartridge 60 is exposed to the outside as described above. At this time, the photoconductor drum 1 and the developing roller 7 are positioned away from each other, thus facilitating a component replacement of the process cartridge 60.

When the process cartridge 60 is folded as illustrated in FIG. 1 or 2, the developer transporter 8 and the toner supply agitator 9 are arranged side by side in the developing unit 10. The developing roller 7 is disposed above the developer transporter 8 and the toner supply agitator 9.

The drum unit 5 is positioned obliquely upward of the developing unit 10. The photoconductor drum 1 of the drum unit 5 is positioned obliquely upward of the developing roller 7.

On the other hand, when the process cartridge 60 is unfolded as illustrated in FIG. 3 or 4, the drum unit 5 pivots approximately 90 degrees around the hinge pins 6 in the counterclockwise direction. At this time, the developing unit 10 is held at the position as illustrated in FIG. 1 or 2.

In an exemplary embodiment of the present invention, each hinge pin 6 serves as a common shaft for foldably and unfoldably coupling the drum unit 5 and the developing unit 10. Thus, an operator can separate the drum unit 5 and the developing unit 10 from each other by moving any one thereof along the longitudinal direction of the photoconductor drum 1.

Then, in order to suppress an accidental separation of the drum unit 5 and the developing unit 10, at least one of the hinge pins 6 may be provided with a stopper for limiting the movement of the drum unit 5 and the developing unit 10 along the longitudinal direction of the photoconductor drum 1.

As described above, the drum unit 5 including the photoconductor drum 1 and the developing unit 10 including the developing roller 7 are foldably and unfoldably coupled with each other by the hinge pins 6, which serve as the common shafts relative to the two units. Thereby the process cartridge 60 can switch between the folded state and the unfolded state without releasing the coupling of the drum unit 5 and the developing unit 10.

Thus, the process cartridge 60 can transform into the unfolded state suitable for maintenance without being disassembled. Further, the process cartridge 60 can return to the folded state so as to be operable in the image forming apparatus 100.

As described above, the photoconductor drum 1 is held via the bearings 12 on the frame of the drum unit 5, while the developing roller 7 is held via the bearings 13 on the frame of the developing unit 10. The respective frames of the drum unit 5 and the developing unit 10 are pivotably coupled to given axes being in parallel with the longitudinal direction of the photoconductor drum 1.

Thus, without using a coupling member, such as a faceplate, for precisely coupling the frames of the drum unit 5 and the developing unit 10, the process cartridge 60 can restore original positions of the photoconductor drum 1 and the developing roller 7 by determining engaging points of the drum unit 5 and the developing unit 10 on the pivot trajectory thereof. Further, the photoconductor drum 1 and the developing roller 7 can pivot in a direction of moving away from each other, and therefore replacement and maintenance operations can be facilitated.

Thus, in an exemplary embodiment of the present invention, a process cartridge can be provided with a relatively simple configuration, increased positioning precision, and increased replaceability of components.

Next, a process cartridge 61 according to another exemplary embodiment of the present invention is described with reference to FIGS. 5 and 6.

The process cartridge 61 has substantially identical configurations to the process cartridge 60 in that a drum unit 5 and a developing unit 10 are foldably and unfoldably coupled by hinge pins 6 to each other. The identical components or members are represented by identical numeral and letter codes to FIGS. 1 to 4, and repeated descriptions thereof are omitted.

Figure 5:
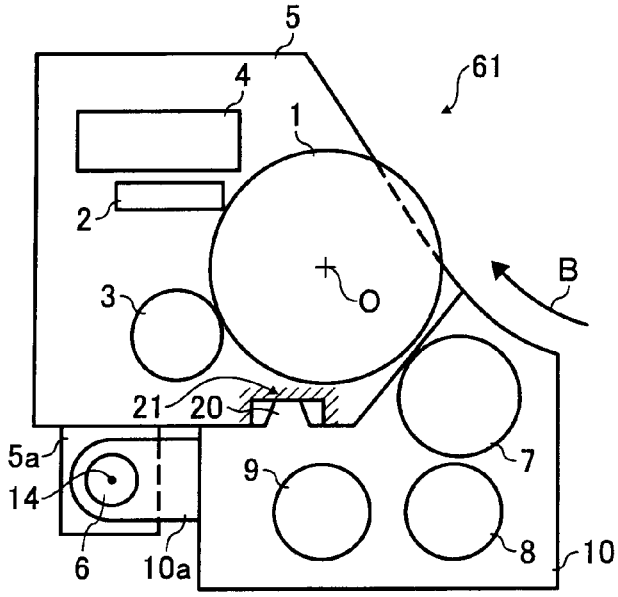
FIG. 5 is a front view illustrating a folded state of a process cartridge according to another exemplary embodiment of the present invention.

FIG. 5 illustrates a folded state where the drum unit 5 and the developing unit 10 are folded toward each other. In the folded state of FIG. 5, a photoconductor drum 1 and a developing roller 7 are operably positioned. An arrow B indicates a conveyance direction of a sheet medium for recording an image.

Figure 6:
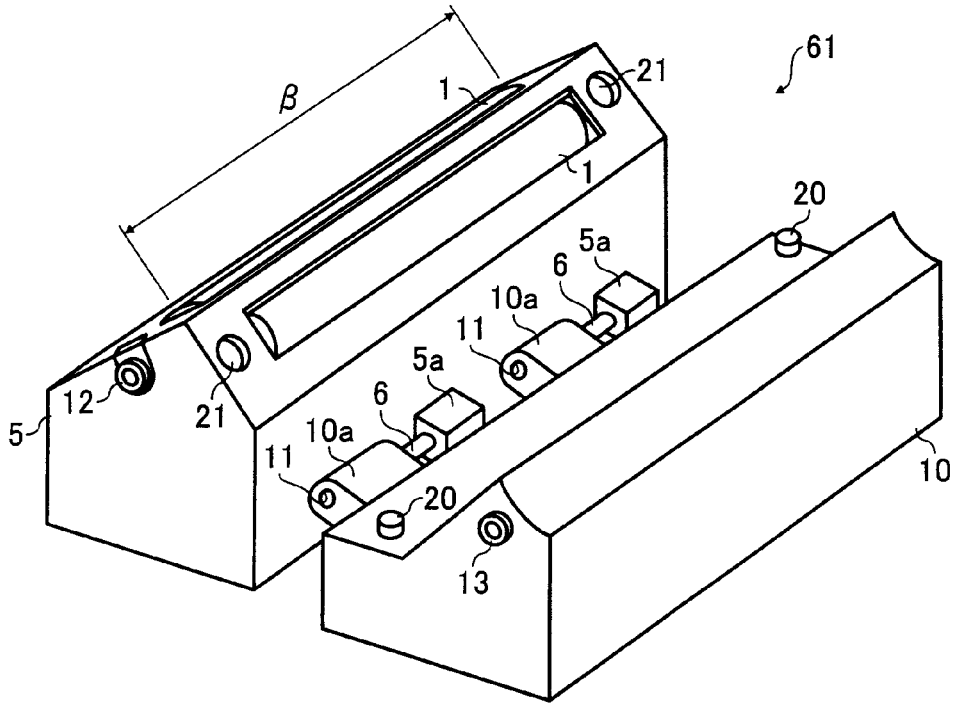
FIG. 6 is a perspective view illustrating an unfolded state of the process cartridge of FIG. 5.

FIG. 6 illustrates an unfolded state where the drum unit 5 and the developing unit 10 are unfolded away from each other.

The developing unit 10 is provided with protrusions 20 on a surface thereof. Specifically, the protrusions 20 are disposed outside a conveying width β of a sheet medium so as not to interfere with the developing roller 7.

On the other hand, the drum unit 5 includes recesses 21. The recesses 21 are disposed on the drum unit 5. Specifically, the recesses 21 are disposed outside the conveying width β of a sheet medium so as not to interfere with the photoconductor drum 1.

When the drum unit 5 and the developing unit 10 pivot around the central axes 14 of the hinge pins 6 from the unfolded state of FIG. 6 until the folded state of FIG. 5, the protrusions 20 are brought into contact with the recesses 21.

Thereby the pivoting movement of the drum unit 5 and the developing unit 10 stops before the photoconductor drum 1 and the developing roller 7 abut against each other. Then the positions of the drum unit 5 and the developing unit 10 are held by the moment of the weight of the drum unit 5.

According to an embodiment of the present invention, the process cartridge 61 includes such a stopping portion, which is formed of the protrusions 20 and the recesses 21 between the drum unit 5 and the developing unit 10.

Thus, an interference between the photoconductor drum 1 and the developing roller 7 can be suppressed when the photoconductor drum 1 and the developing roller 7 come close to each other during a replacement operation of components.

The recesses 21 may be positioning recesses or holes for engaging with the protrusions 20 and appropriately positioning the drum unit 5 and the developing unit 10.

Such a configuration allows the process cartridge 61 to effectively restore the positions of components, which leads to the reduction of scratches and dents on a coating of the photoconductor drum 1 during a replacement operation of components, etc.

As described above, the process cartridge 61 includes a mechanism of regulating the distance between the photoconductor drum 1 and the developing roller 7.

Thus, an interference between the photoconductor drum 1 and the developing roller 7 can be effectively suppressed during disassembly and assembly of the process cartridge 61.

Thus scratches on the coating of the photoconductor drum 1 or an image degradation due to a deformation of the photoconductor drum 1 or the developing roller 7 can also be suppressed.

In the process cartridge 61 according to an exemplary embodiment of the present invention, the protrusions 20 are provided on the developing unit 10, while the recesses 21 are provided on the drum unit 5. Alternatively, the protrusions 20 may be provided on the drum unit 5, while the recesses 21 may be provided on the developing unit 10.

Next, a process cartridge 62 according to another exemplary embodiment of the present invention is described with reference to FIGS. 7 and 8.

The process cartridge 62 has substantially identical configurations to the process cartridge 60 or 61 in that a drum unit 5 and a developing unit 10 are foldably and unfoldably coupled by hinge pins 6 to each other. The identical components or members are represented by identical numeral and letter codes of FIGS. 1 to 6, and repeated descriptions thereof are omitted.

Figure 7:
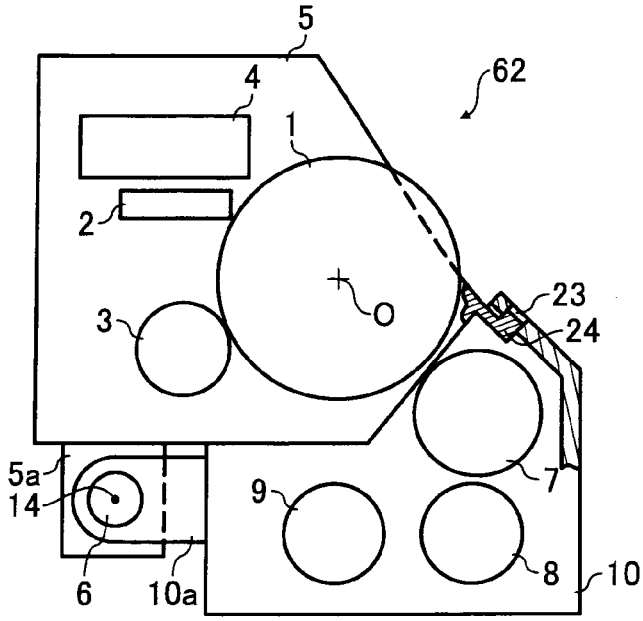
FIG. 7 is a front view illustrating a folded state of a process cartridge according to another exemplary embodiment of the present invention.
Figure 8:
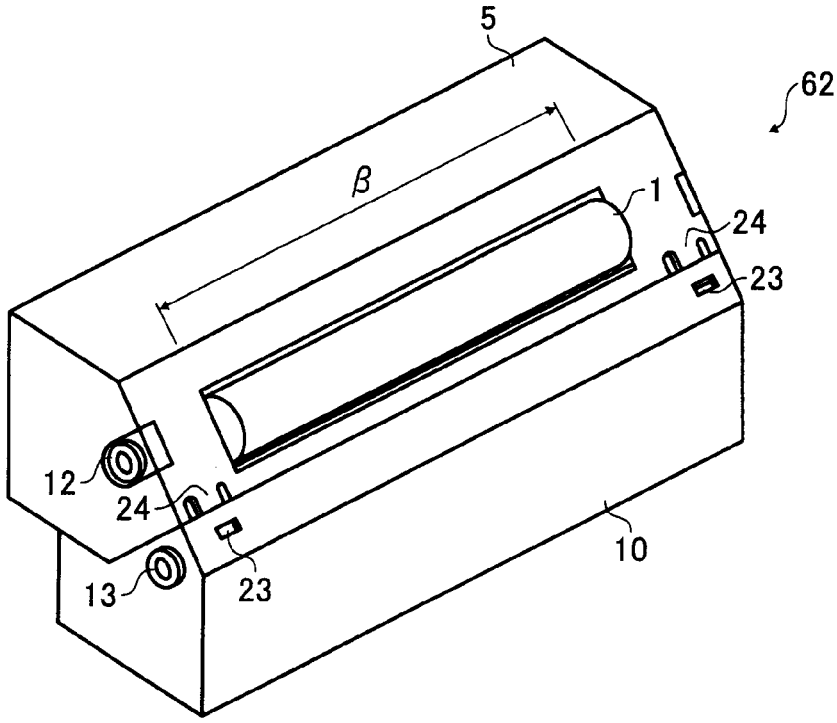
FIG. 8 is a perspective view illustrating a folded state of the process cartridge of FIG. 7.

FIGS. 7 and 8 illustrate folded states where the drum unit 5 and the developing unit 10 are folded toward each other.

As illustrated in FIGS. 7 and 8, the developing unit 10 is provided with holes 23 on a surface thereof. Specifically, the holes 23 are disposed outside a conveying width β of a sheet medium as illustrated in FIG. 8.

The drum unit 5 is provided with stoppers 24. The stoppers 24 protrude from a surface of the drum unit 5 toward the developing unit 10.

The drum unit 5 and the developing unit 10 pivot toward each other around the central axes 14 of the hinge pins 6 so that a photoconductor drum 1 and a developing roller 7 are operably positioned.

When the stoppers 24 are inserted into the corresponding holes 23, the pivoting of the drum unit 5 and the developing unit 10 stops. At this time, if the stoppers 24 and the holes 23 are firmly engaged with each other, the drum unit 5 and the developing unit 10 can be held together in a fixed state.

Each stopper 24 may further include an engaging portion for regulating the movement of the drum unit 5 and the developing unit 10 along a longitudinal direction of the photoconductor drum 1.

Further, the stoppers 24 may be configured to have a rigidity capable of slightly bending toward the inside of the developing unit 10. Thus, when the drum unit 5 and the developing unit 10 pivot around the central axes 14 so as to come close to each other, the stoppers 24 can be smoothly inserted into the holes 23.

According to an exemplary embodiment of the present invention, as illustrated in FIGS. 7 and 8, when the photoconductor drum 1 and the developing roller 7 come close to each other, the stoppers 24 of the drum unit 5 are engagingly inserted into the corresponding holes 23 of the developing unit 10. Thus, the photoconductor drum 1 and the developing roller 7 can securely hold a distance so as not to interfere with each other.

In the process cartridge 62 according to an exemplary embodiment of the present invention, the holes 23 are provided on the developing unit 10, while the stoppers 24 are provided on the drum unit 5. Alternatively, the holes 23 may be provided on the drum unit 5, while the stoppers 24 may be provided on the developing unit 10.

Further, the configuration of the process cartridge 62 as described above may be used together with the configuration of the process cartridge 61 as illustrated in FIGS. 5 and 6.

For the process cartridge 62 according to an embodiment of the present invention, the drum unit 5 and the developing unit 10 pivot around the central axes 14 so that the photoconductor drum 1 and the developing roller 7 come close to each other.

When the photoconductor drum 1 and the developing roller 7 are closed so as to be operably positioned, a protruding portion of each stopper 24 of the drum unit 5 engages with the corresponding hole 23 of the developing unit 10. A base portion of each stopper 24 is flatly shaped so as to regulate the extent in which the protruding portion of each stopper 24 is inserted into the hole 23.

Thereby the drum unit 5 and the developing unit 10 can hold the folded state as described above. The folded state can be released with a single touch operation. Thus, the process cartridge 62 can hold and release the folded state of the drum unit 5 and the developing unit 10 without using a fastening member such as a screw.

In other words, the drum unit 5 and the developing unit 10 do not necessarily need a fastening member or a locking mechanism. Therefore the efficiency of the assembly operation of the process cartridge 62 can be increased.

Next, a process cartridge 63 according to another exemplary embodiment of the present invention is described with reference to FIGS. 9 and 10.

Figure 9:
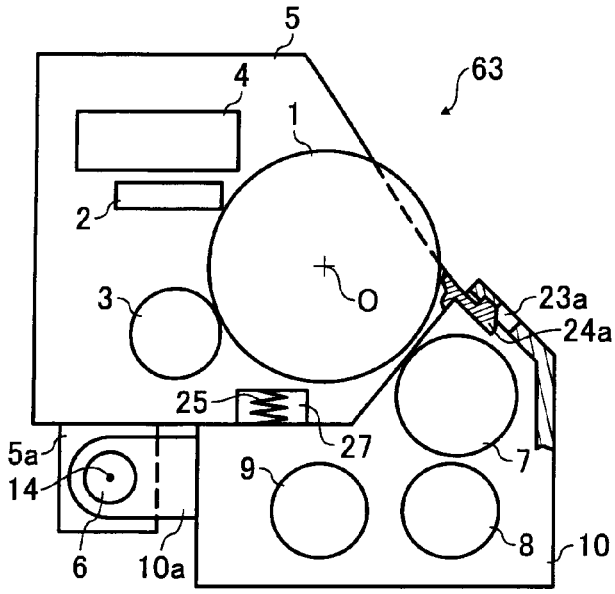
FIG. 9 is a front view illustrating a folded state of a process cartridge according to another exemplary embodiment of the present invention.
Figure 10:
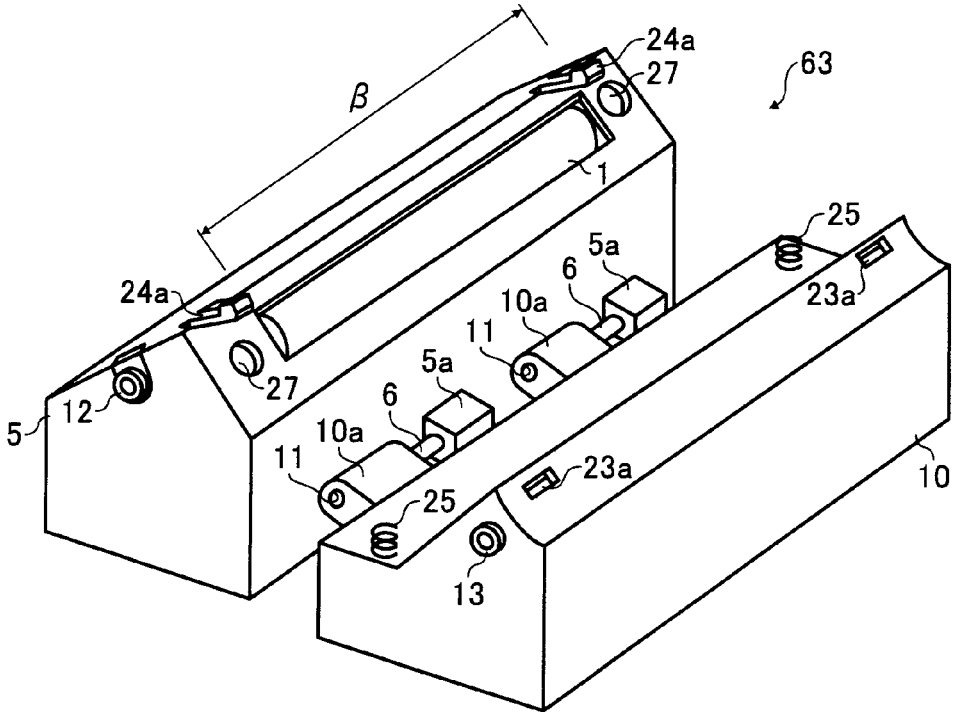
FIG. 10 is a perspective view illustrating an unfolded state of the process cartridge of FIG. 9.

As illustrated in FIGS. 9 and 10, for the process cartridge 63, holes 23*a* are provided on a developing unit 10, while protruding stoppers 24*a* are provided on a drum unit 5. When a photoconductor drum 1 and a developing roller 7 come close to each other, the protruding stoppers 24*a* are engagingly inserted into the corresponding holes 23*a*.

Thus, the photoconductor drum 1 and the developing roller 7 can hold a distance so as not to interfere with each other.

As illustrated in FIG. 10, each of the protruding stoppers 24*a* has a hook portion for stopping a pivoting of the photoconductor drum 1 and the developing roller 7 in a direction of moving away from each other. When the photoconductor drum 1 and the developing roller 7 are folded as illustrated in FIG. 9, the protruding stoppers 24*a* are inserted into the corresponding holes 23*a*.

The developing unit 10 is provided with springs 25 or other biasing members such as sponge seals (not illustrated). The springs 25 are disposed at positions on a surface of the developing unit 10 facing the drum unit 5. The springs 25 or other biasing members bias the photoconductor drum 1 and the developing roller 7 away from each other.

The drum unit 5 is provided with concaves 27 for receiving the biasing force of the springs 25. Thus the process cartridge 63 is configured to have a biasing force when the drum unit 5 and the developing unit 10 are folded as illustrated in FIG. 9.

As illustrated in FIG. 10, the holes 23*a*, the protruding stoppers 24*a*, the springs 25, and the concaves 27 are disposed outside a conveying width $\beta$ of a sheet medium.

The biasing force of the springs 25 presses the hook portions of the protruding stoppers 24*a* against corresponding engaging surfaces of the holes 23*a*. Thus, the drum unit 5 and the developing unit 10 can hold the folded state as illustrated in FIG. 9.

Further, similar to the process cartridge 62, the protruding stoppers 24*a* have a rigidity capable of slightly bending toward the inside of the developing unit 10.

Thus, when the drum unit 5 and the developing unit 10 pivot around the central axis 14 so as to come close to each other, the stoppers 24*a* can be smoothly inserted into the holes 23*a*.

In an exemplary embodiment of the present invention, the protruding stoppers 24*a* have hook portions. The springs 25 or other biasing members such as sponge seals are disposed at positions on a surface of the developing unit 10 facing the drum unit 5 so as to bias the photoconductor drum 1 and the developing roller 7 away from each other.

In such a configuration, when the drum unit 5 and the developing unit 10 pivot so that the photoconductor drum 1 and the developing roller 7 come close to each other so as to be operably positioned, the hook portions of the protruding stoppers 24*a* are biased against the engaging surfaces of the holes 23*a* as illustrated in FIG. 9. Thereby the frame of the developing unit 10 can be appropriately positioned.

Thus, without using any fastening member, the process cartridge 63 can hold the folded state where the photoconductor drum 1 and the developing roller 7 are operably positioned.

As described above, the process cartridge 62 does not necessarily need a fastening member, such as a screw, or a locking mechanism to hold and release the folded state as illustrated in FIG. 7 or 8 while the distance between the photoconductor drum 1 and the developing roller 7 is preferably held with relatively high precision.

Such process cartridge 62 may need a precise engagement between the stoppers 24 and the holes 23 to preferably suppress looseness of engagement between the stoppers 24 and the holes 23 so that the drum unit 5 and the developing unit 10 may be effectively positioned with each other when folded. Consequently, the process cartridge 62 may need some time and effort in the manufacturing of components thereof.

On the other hand, the process cartridge 63 can hold a preferable positional relationship between the photoconductor drum 1 and the developing roller 7 by a relatively simple configuration as described above. Thus, the time and effort may be reduced in the manufacturing of components thereof.

Next, a process cartridge 64 according to another exemplary embodiment of the present invention is described with reference to FIGS. 11 and 12.

Figure 11:
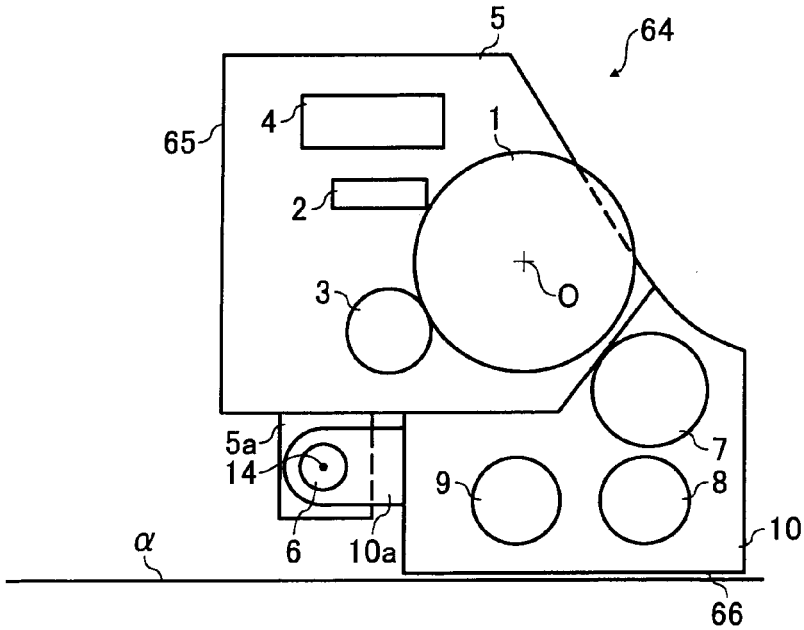
FIG. 11 is a front view illustrating a folded state of a process cartridge according to another exemplary embodiment of the present invention.

FIG. 11 illustrates a folded state where the drum unit 5 and the developing unit 10 are folded toward each other.

Figure 12:
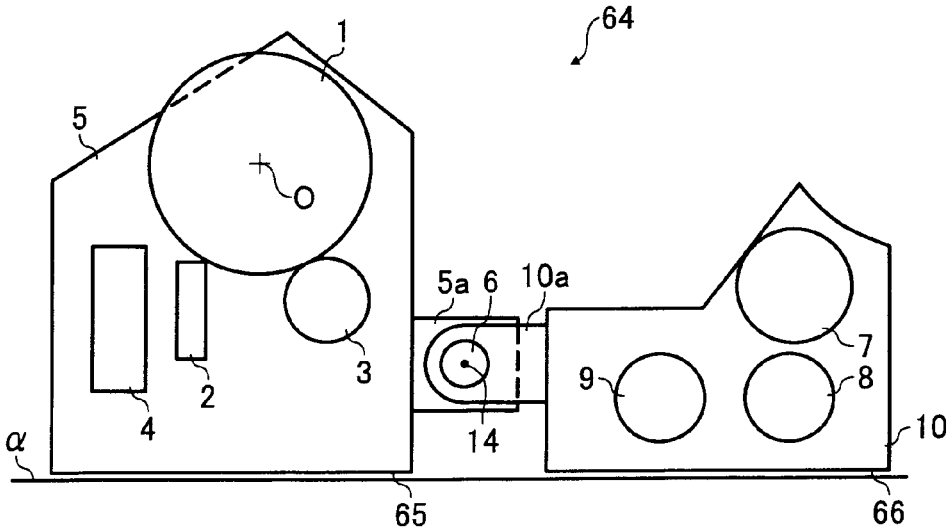
FIG. 12 is a front view illustrating an unfolded state of the process cartridge of FIG. 11.

FIG. 12 is an unfolded state where the drum unit 5 and the developing unit 10 are unfolded away from each other.

The configuration of the process cartridge 64 according to an exemplary embodiment of the present invention can be applied to any of the process cartridges 60 to 64 according to the above-described exemplary embodiments.

Similar to the above-described exemplary embodiments, a drum unit 5 is provided with first support members 5*a*, while a developing unit 10 is provided with second support members 10*a*. Each of the first support members 5*a* and the second support members 10*a* has an engaging hole 11.

Hinge pins 6 are inserted into the corresponding engaging holes 11 of the first support members 5*a* and the second support members 10*a* in parallel with a longitudinal direction of a photoconductor drum 1. Thus, the hinge pins 6 pivotably couple the drum unit 5 and the developing unit 10 to integrally form the process cartridge 64.

When the process cartridge 64 is mounted on an image forming apparatus, the process cartridge 64 is in a folded state as illustrated in FIG. 11. On the other hand, after the process cartridge 64 is withdrawn from the image forming apparatus, the process cartridge 64 can take a position as illustrated in FIG. 12, in which the drum unit 5 and the developing unit 10 are unfolded so as to be convenient for component replacement.

When the photoconductor drum 1 and the developing roller 7 are positioned substantially farthest away from each other as illustrated in FIG. 12, flat surfaces 65 and 66 of the drum unit 5 and the developing unit 10 fit a plane $\alpha$. In other words, in the unfolded state, the drum unit 5 and the developing unit 10 have flat surfaces 65 and 66, respectively, for simultaneously contacting the plane $\alpha$ to stably support the process cartridge 64 as a whole.

In an exemplary embodiment of the present invention, the flat surface 65 of the drum unit 5 forms a vertical plane when the process cartridge 64 is folded as illustrated in FIG. 11.

Then, the flat surface 66 of the developing unit 10 is disposed in parallel with a horizontal plane being perpendicular to the flat surface 65.

When the process cartridge 64 is unfolded as illustrated in FIG. 12, the flat surfaces 65 and 66 contact the plane α to stably support the process cartridge 64 as a whole.

Thus, in the unfolded state of FIG. 12, the flat surfaces 65 and 66 contact the plane α, and the process cartridge 64 stably fits to a flat face such as table face. Accordingly, a replacement operation of components can be facilitated.

Next, a process cartridge 70 according to another exemplary embodiment of the present invention is described with reference to FIGS. 13 and 14.

The process cartridge 70 has a different layout of components in a drum unit 5 and a developing unit 10 from any of the process cartridges 60 to 64 as described above. Therefore, the process cartridge 70 has also different in the outer shapes of the drum unit 5 and the developing unit 10.

Figure 13:
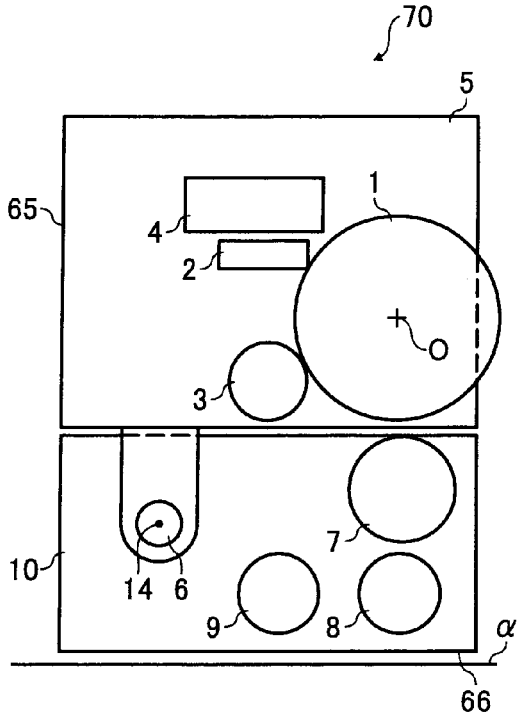
FIG. 13 is a front view illustrating a folded state of a process cartridge according to another exemplary embodiment of the present invention.

FIG. 13 illustrates a folded state of the process cartridge 70 where the drum unit 5 and the developing unit 10 are folded toward each other.

Figure 14:
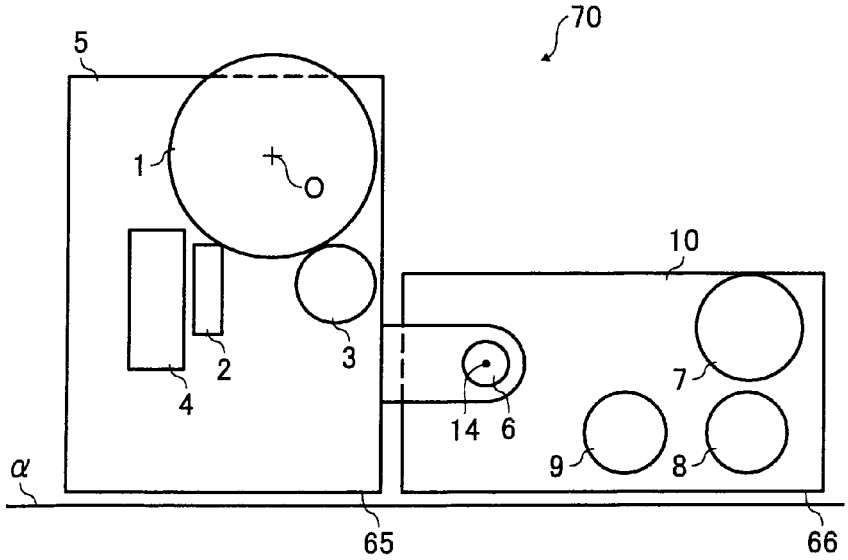
FIG. 14 is a front view illustrating an unfolded state of the process cartridge of FIG. 13.

FIG. 14 illustrates an unfolded state thereof where the drum unit 5 and the developing unit 10 are unfolded away from each other.

As illustrated in FIGS. 13 and 14, the process cartridge 70 includes the drum unit 5 and the developing unit 10, both of which have rectangular shapes.

In FIGS. 13 and 14, identical numeral and letter codes are used for the other components having substantially identical functions to the above-described exemplary embodiments.

When the process cartridge 70 is folded as illustrated in FIG. 13, the drum unit 5 is stacked on the developing unit 10. When the drum unit 5 pivots approximately 90 degrees to the left around the hinge pins 6 from the position of FIG. 13, the process cartridge 70 is unfolded as illustrated in FIG. 14.

The drum unit 5 and the developing unit 10 have flat surfaces 65 and 66 to fit a plane α when a photoconductor drum 1 and a developing roller 7 are substantially farthest away from each other as illustrated in FIG. 14.

In other words, in the unfolded state, the drum unit 5 and the developing unit 10 have the flat surfaces 65 and 66, respectively, for simultaneously contacting the plane α to stably support the process cartridge 70 as a whole.

In an exemplary embodiment of the present invention, the flat surface 65 of the drum unit 5 forms a vertical plane when the process cartridge 64 is in the folded state as illustrated in FIG. 13. At this time, the flat surface 66 of the developing unit 10 is disposed in parallel with a horizontal plane being perpendicular to the flat surface 65.

When the process cartridge 70 is in the unfolded state as illustrated in FIG. 14, the flat surfaces 65 and 66 contact the identical plane α to stably support the process cartridge 70 as a whole.

In an exemplary embodiment of the present, when the drum unit 5 and the developing unit 10 are pivoted into a position suitable for component replacement, respective surfaces of the drum unit 5 and the developing unit 10 stably fit a flat surface of a workbench or so forth. Therefore, an operator can perform a replacement operation of components while suppressing an unintentional move of the process cartridge 70. Thus, operators such as service or repair persons can effectively perform assembly and disassembly operations of the process cartridge 70 in a more compact space on a table or floor.

Next, a process cartridge 80 according to another exemplary embodiment of the present invention is described with reference to FIGS. 15 and 16.

Similar to the above-described exemplary embodiments, a developing unit 10 has engaging holes 11. Hinge pins 6 are inserted into the engaging hole 11 in parallel with a longitudinal direction of a photoconductor drum 1. Thereby the hinge pins 6 pivotably couple the drum unit 5 and the developing unit 10.

In the process cartridge 80, a developing roller unit 30 is formed as a single unit separately from the developing unit 10. The developing roller unit 30 includes a developing roller 7, while the developing unit 10 includes a developer transporter 8 and a toner supply agitator 9.

The developing unit 10 has engaging holes 32. Hinge pins 31 are inserted into the engaging holes 32 in parallel with a longitudinal direction of the photoconductor drum 1. Thus, the hinge pins 31 pivotably couple the developing unit 10 and the developing roller unit 30.

Figure 15:
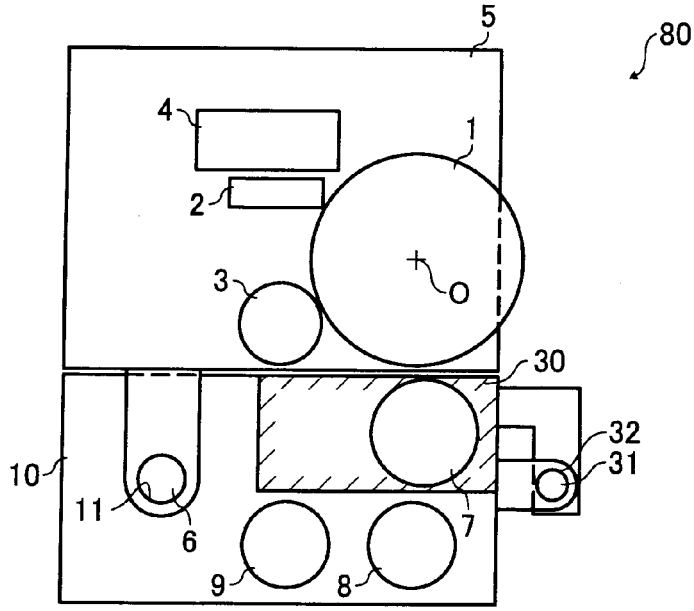
FIG. 15 is a front view illustrating a folded state of a process cartridge according to another exemplary embodiment of the present invention.

From the folded state as illustrated in FIG. 15, the drum unit 5 is pivoted around the hinge pin 6 so as to be unfolded relative to the developing unit 10. Then the developing roller unit 30 is exposed to the outside.

When the developing roller unit 30 is pivoted around the hinge pin 31 away from the developing unit 10, the developer transporter 8 and the toner supply agitator 9 are exposed to the outside. Thus, a replacement or refill operation of developer can be facilitated.

At this time, the developing roller 7 of the developing roller unit 30 is also exposed to the outside. Thus, maintenance and replacement operations of the developing roller 7 can also be facilitated.

Figure 16:
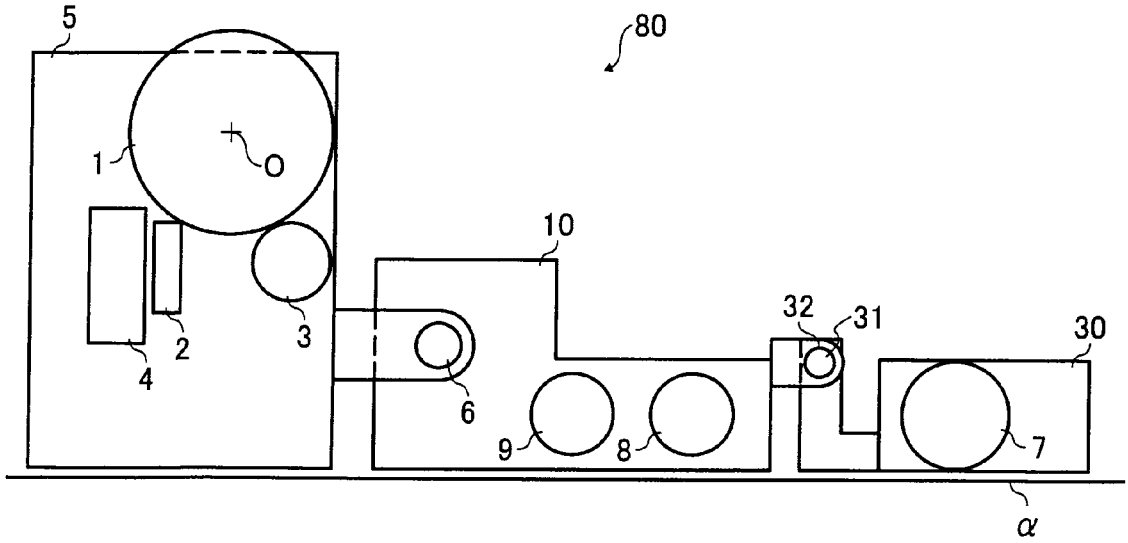
FIG. 16 is a front view illustrating an unfolded state of the process cartridge of FIG. 15.

In an exemplary embodiment of the present invention, the developing roller unit 30 may be configured to have a surface capable of stably fitting a plane α as illustrated in FIG. 16 when the process cartridge 80 is unfolded.

Any of the above-described process cartridges 60 to 64, 70, and 80 can adjust the gap between the photoconductor drum 1 and the developing roller 7 in a relatively simple manner. For example, the gap can be adjusted by changing the height of the protrusions 20, the first support members 5*a*, or the second support members 10*a*, which is provided on the drum unit 5 or the developing unit 10.

Thus, when the process cartridge is in the unfolded state, an operator can perform a component replacement operation or a maintenance operation such as the gap adjustment. After finishing the replacement or maintenance operation, the drum unit 5 and the developing unit 10 are pivoted toward each other. Thus, the process cartridge 80 can restore the folded state.

Next, a process cartridge 91 according to another exemplary embodiment of the present invention is described with reference to FIGS. 17 and 18.

Figure 17:
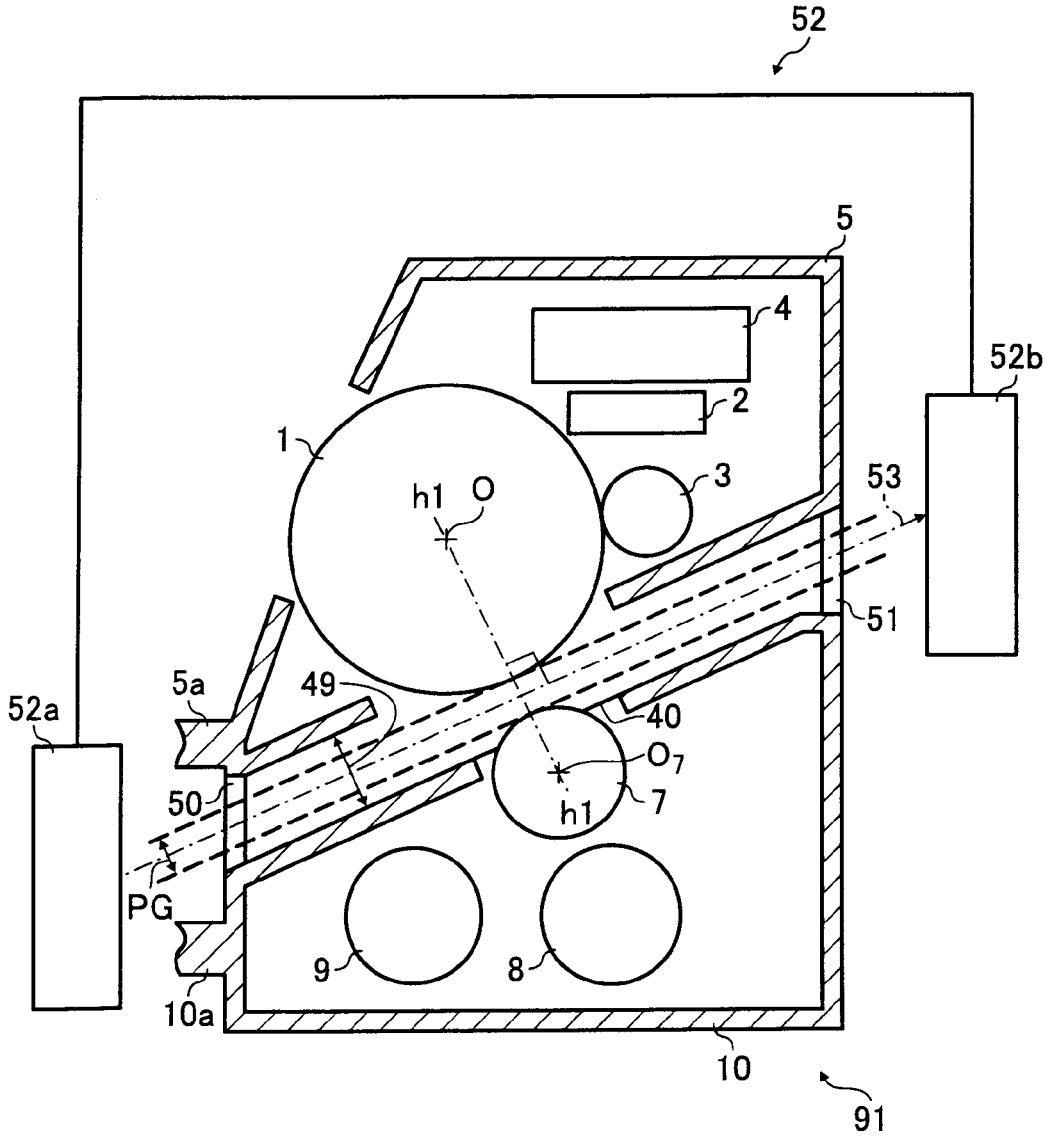
FIG. 17 is a sectional view illustrating a folded state of a process cartridge according to another exemplary embodiment of the present invention.

FIG. 17 is a sectional view illustrating a folded state of the process cartridge 91.

Figure 18:
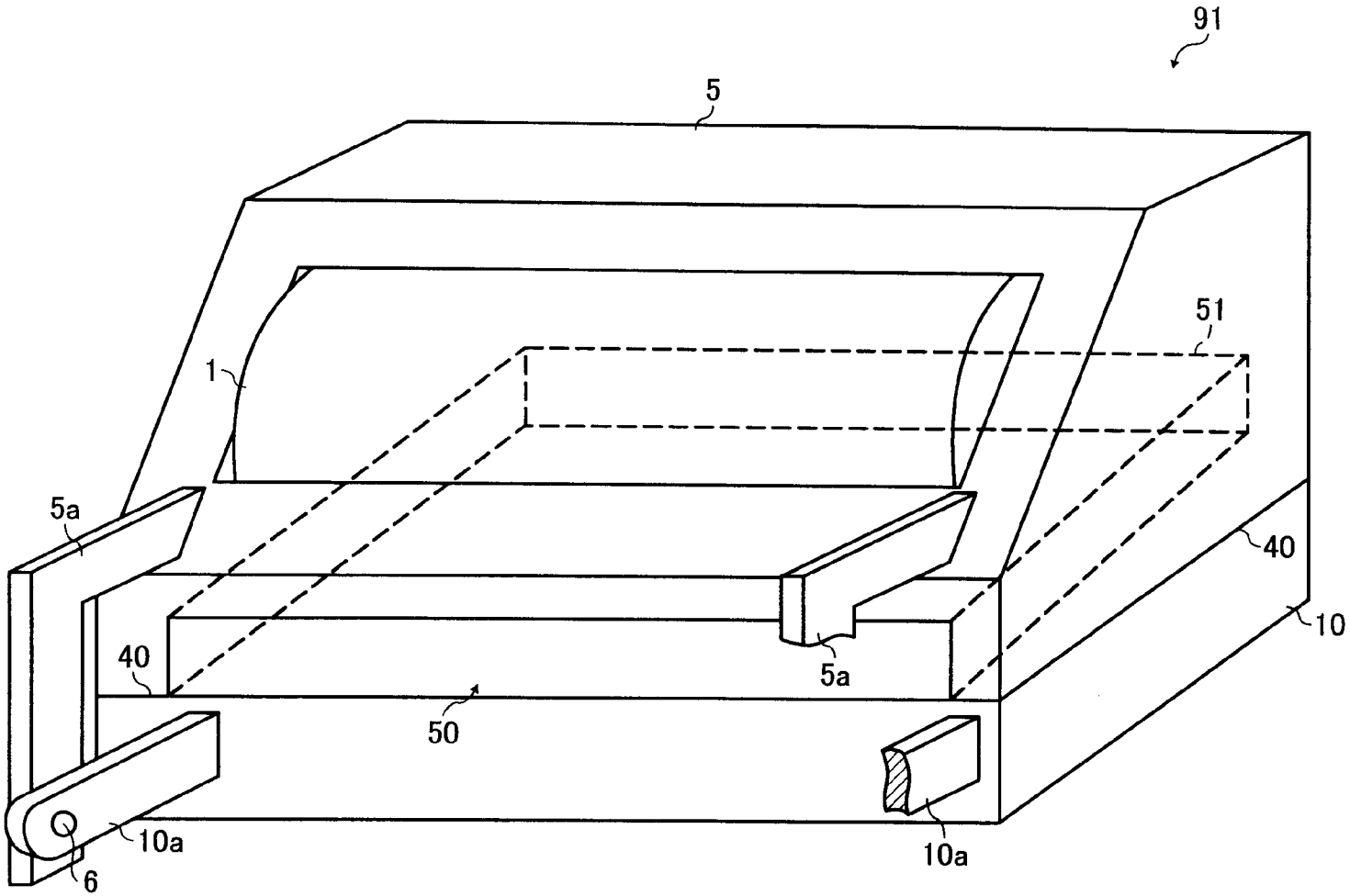
FIG. 18 is a perspective view illustrating a folded state of the process cartridge of FIG. 17.

FIG. 18 is a perspective view illustrating a folded state of the process cartridge 91 illustrated in FIG. 17.

As illustrated in FIGS. 17 and 18, the process cartridge 91 includes a drum unit 5 as a first unit and a developing unit 10 as a second unit. The drum unit 5 also includes a photoconductor drum 1, while the developing unit 10 includes a developing roller 7.

The drum unit 5 is integrally provided with two support members 5*a*, while the developing unit 10 is integrally provided with two support members 10*a*. The respective supports 5*a* are coupled with the corresponding support members 10*a* via hinge pins 6 as illustrated in FIG. 18. The hinge pins 6 are disposed so as to have substantially identical axes relative to each other. The drum unit 5 and the developing unit 10 are pivoted around the hinge pins 6 so as to be folded and unfolded relative to each other.

The hinge pins 6 are disposed at positions so that the drum unit 5 and the developing unit 10 do not interfere with each other when the drum unit 5 and the developing unit 10 pivot around the hinge pins 6.

As described above, FIGS. 17 and 18 illustrate folded states of the process cartridge 91.

Figure 27:
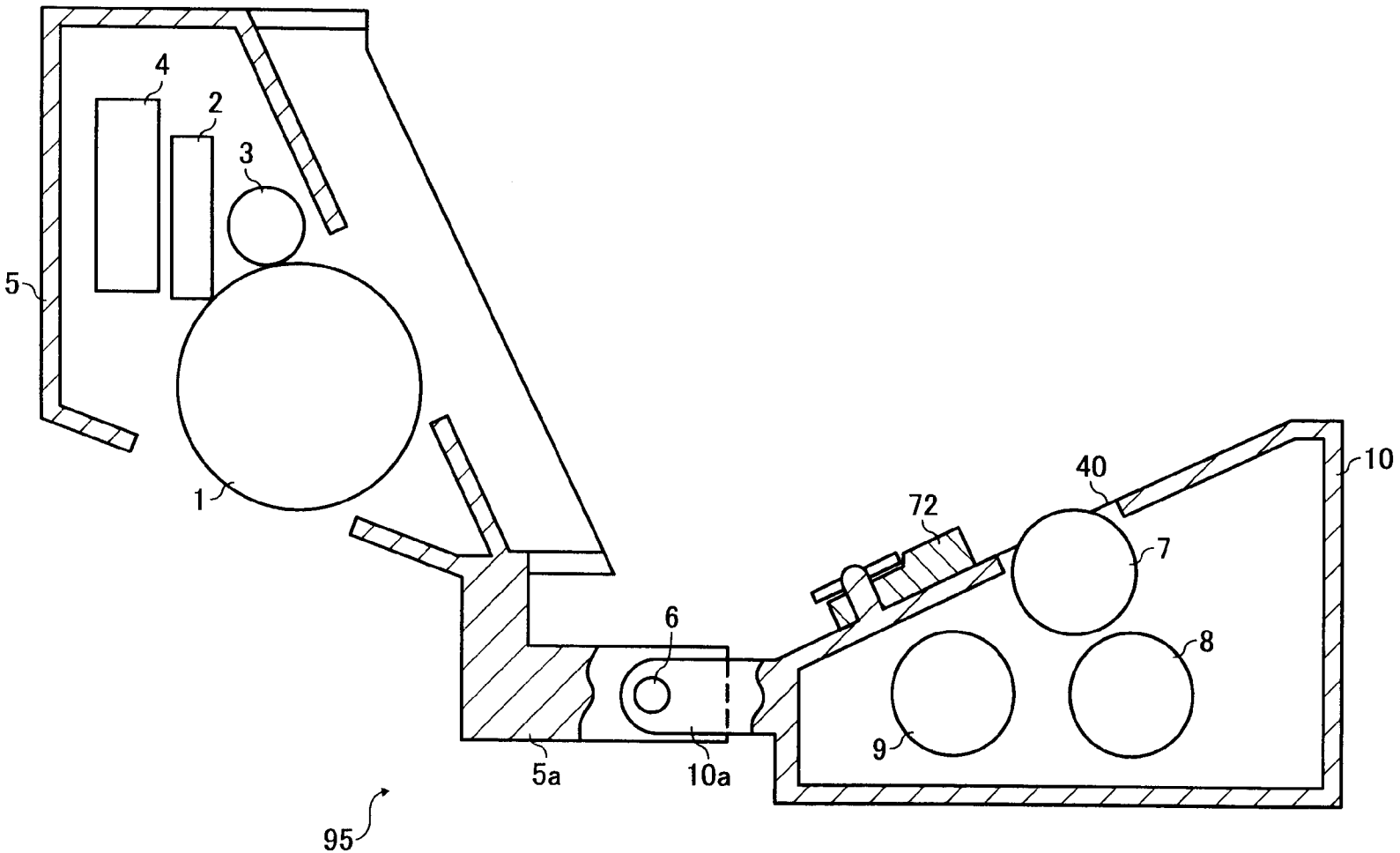
FIG. 27 is a sectional view illustrating an unfolded state of the process cartridge of FIG. 25.

When the drum unit 5 and the developing unit 10 are unfolded away form each other, the process cartridge 91 takes a similar position as illustrated in FIG. 3 or FIG. 27 (described later). In the unfolded state, the upper side of the drum unit 5 is exposed to the outside. Thus, replacement and maintenance operations of the photoconductor drum 1 can be facilitated.

At this time, the upper side of the developing unit 10 is also exposed to the outside. Thus, replacement and maintenance operations of the developing roller 7, the developer transporter 8, and the toner supply agitator 9 can also be facilitated. In this regard, an interface line 40, as illustrated in FIGS. 17 and 18, represents an interface between the drum unit 5 and the developing unit 10, which is formed when the process cartridge 91 is folded.

As illustrated in FIG. 17, the drum unit 5 also includes a photoconductor cleaner 2, a charger 3, and a waste toner container 4 besides the photoconductor drum 1. The developing unit 10 also includes a developer transporter 8 and a toner supply agitator 9 besides the developing roller 7.

A central axis O of the photoconductor drum 1 is disposed in parallel with a central axis $O_7$ of the developing roller 7. The folded state of the process cartridge 91 is held by a locking mechanism.

In the folded state, a through space 49 is formed along a normal line direction of a virtual plane h1-h1 including both the central axes O and $O_7$.

The through space 49 passes through between the drum unit 5 and the developing unit 10 so as to include a processing gap PG. The processing gap PG is a distance between outer surfaces of the photoconductor drum 1 and the developing roller 7.

The process cartridge 91 has openings 50 and 51 on side portions of the drum unit 5. The through space 49 passes through the process cartridge 91 via the openings 50 and 51.

When measuring the processing gap PG, a measuring device 52 is positioned outside the process cartridge 91, which is folded as illustrated in FIG. 17.

The measuring device 52 includes an irradiation aperture 52*a* from which light is irradiated for measuring the processing gap PG. The measuring device 52 also includes a sensor 52*b* for receiving the light irradiated from the irradiation aperture 52*a*.

The irradiation aperture 52*a* is positioned outside an opening 50, while the sensor 52*b* is positioned outside an opening 51. The irradiation aperture 52*a* faces the sensor 52*b* via the through space 49.

Light 53, which is irradiated from the irradiation aperture 52*a*, sequentially goes through the opening 50, the processing gap PG, and the opening 51. Then the sensor 52*b* detects the light 53 and determines the width of the processing gap PG.

Currently, many image forming sections of image forming apparatuses are integrally formed as compact-size process cartridges to facilitate maintenance and replacement operations. In such a process cartridge, the width of the processing gap PG have some effect on the quality of an image formed on a recording medium. Therefore, the processing gap PG is preferably adjustable to obtain a desired image quality.

However, a conventional process cartridge may need to be disassembled in order to remeasure the width of the processing gap PG after the assembly thereof. Alternatively, for another conventional process cartridge, the processing gap PG is measured by detecting a pressure applied from a contact terminal. In this case, a photoconductor drum may be replaced with a specialized drum for measurement. Therefore, such a conventional process cartridge may need some time and effort for the measurement of the processing gap PG. Additionally, the processing gap PG is not measured for the photoconductor drum actually used in an image forming apparatus.

In an exemplary embodiment of the invention, the measuring device 52 measures the processing gap PG by transmitting the light 53 after the assembly of the process cartridge 91. As described above, the process cartridge 91 has the through space 49 including the processing gap PG. The through space 49 passes through between the drum unit 5 and the developing unit 10 along a normal line direction of the virtual plane h1-h1, which includes the central axis O of the photoconductor drum 1 and the central axis $O_7$ of the developing roller 7.

Then the measuring device 52 transmits the light 53 from the outside of the through space 49. Thus, the processing gap PG can be measured without disassembling the process cartridge 91.

Further, the measurement of the processing gap PG on a manufacturing line can be facilitated, thus resulting in more effective quality assurance. Even if a failure occurs in the process cartridge 91 on the manufacturing line, the failure can be analyzed without disassembling the process cartridge 91.

Figure 19:
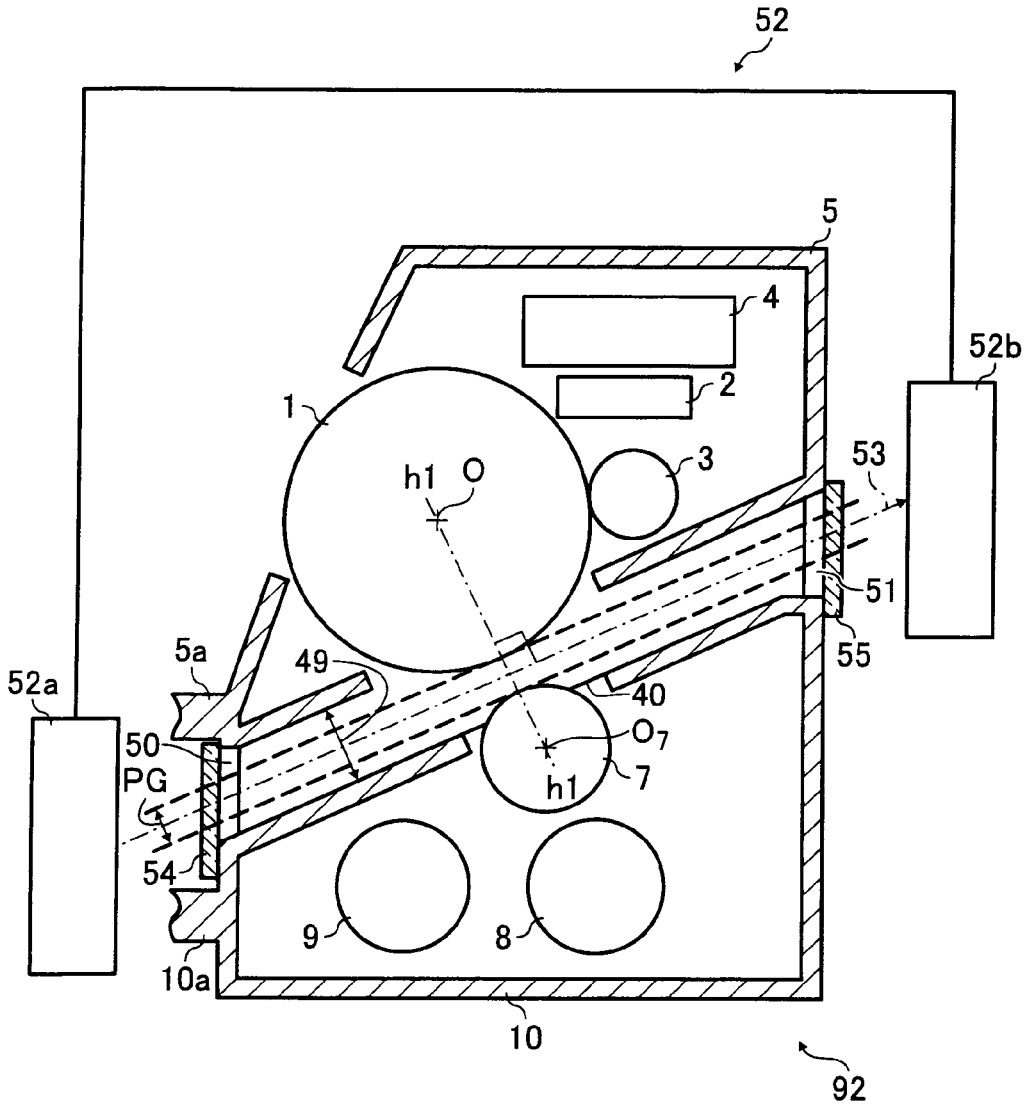
FIG. 19 is a sectional view illustrating a folded state of a process cartridge according to another exemplary embodiment of the present invention.
Figure 20:
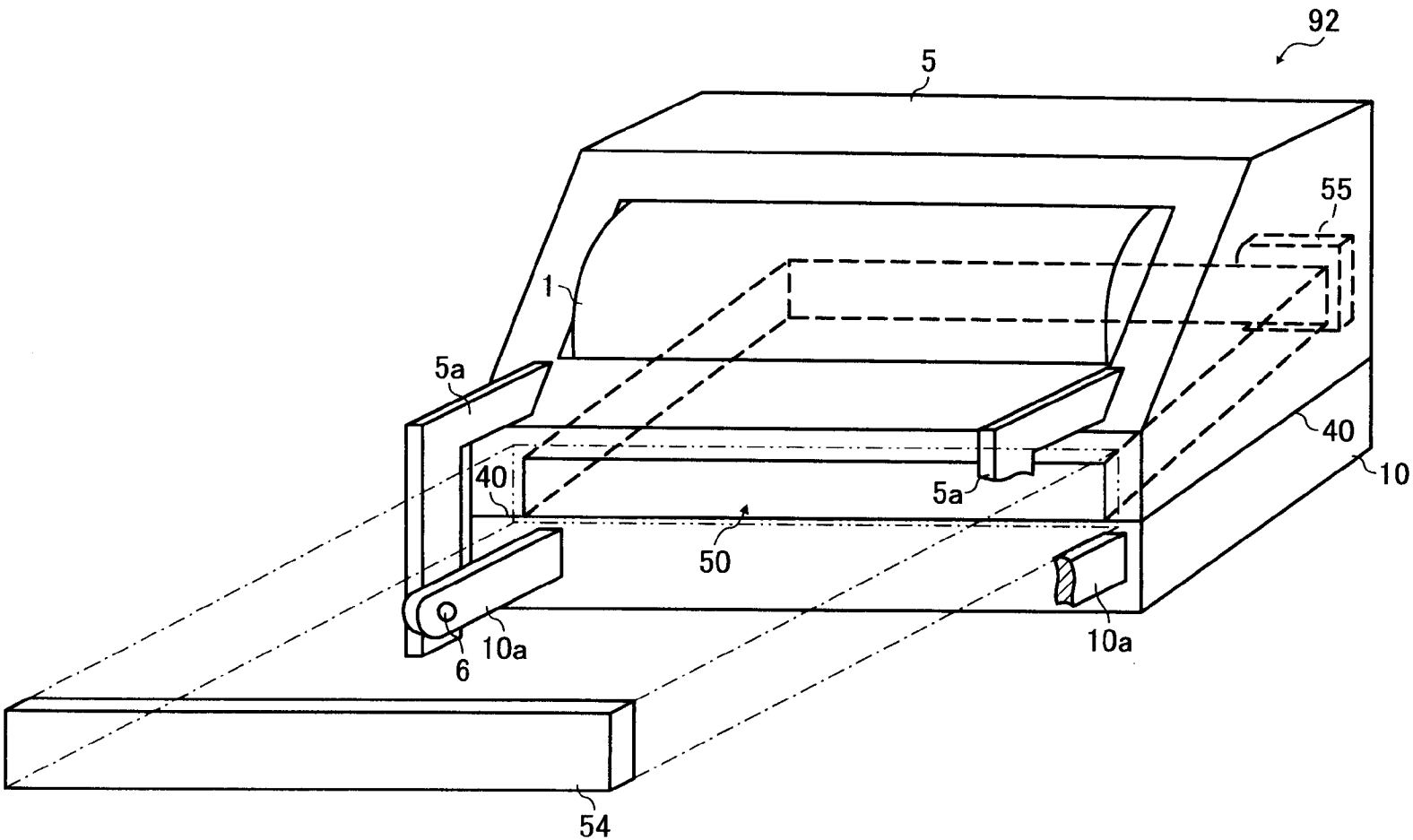
FIG. 20 is a perspective view illustrating a folded state of the process cartridge of FIG. 19.

Next, a process cartridge 92 according to another exemplary embodiment of the present invention is described with reference to FIGS. 19 and 20.

The process cartridge 92 has substantially identical configurations to the process cartridge 91 as illustrated in FIGS. 17 and 18. The identical components or members are represented by identical codes of FIGS. 17 and 18, and repeated descriptions thereof are omitted.

As illustrated in FIGS. 17 and 18, the process cartridge 91 has the openings 50 and 51 on the ends of the through space 49. When the openings 50 and 51 remain open, the process cartridge 91 may have lower dustproof performance, which may lead to image deterioration due to dust.

Hence, according to an exemplary embodiment of the present invention, the process cartridge 92 is configured so as to have an increased dustproof performance.

Specifically, the process cartridge 92 includes a through space 49, openings 50 and 51, and transparent boards 54 and 55. The transparent boards 54 and 55 are disposed so as to close the openings 50 and 51, respectively. The transparent boards 54 and 55 are also supported at side-wall portions of a drum unit 5 and a developing unit 10 by the outer frame of the process cartridge 92.

Thus, the transparent board 54 is fixed on the outer frame of the process cartridge 92 so as to close the opening 50. The transparent board 55 is fixed on the outer frame of the process cartridge 92 so as to close the opening 51.

The transparent boards 54 and 55 are also fixed on the outer frame of the process cartridge 92 with an adhesive seal or a screw. Thus, by closing the opening 50 and 51, the entry of dust from the outside of the process cartridge 92 may be suppressed.

The transparent boards 54 and 55 are transparent to light. Therefore, in a similar way to the process cartridge 91, the process cartridge 92 can measure a processing gap PG, which is a distance between outer surfaces of the photoconductor drum 1 and the developing roller 7, by using a measuring device 52.

Further, by closing the openings 54 and 55, the process cartridge 92 can suppress the entry of dirt and dust into the interior thereof. Thus, the process cartridge 92 can reduce the time for a cleaning step as generally performed in the manufacturing process thereof.

As a result, for example, setting of clean rooms may become unnecessary in the manufacturing facilities. Thus, the time and cost for dust protection in the manufacturing facilities can be reduced, resulting in a reduction of the manufacturing cost of the process cartridge 92.

Next, a process cartridge 93 according to another exemplary embodiment of the present invention is described with reference to FIGS. 21 and 22.

The process cartridge 93 has substantially identical configurations to the process cartridge 91 as illustrated in FIGS. 17 and 18. The identical components or members are represented by identical numeral and letter codes to FIGS. 17 and 18, and repeated descriptions thereof are omitted.

The process cartridge 93 includes a sealing member 72, such as a seal or a cover, for sealing opening portions of the drum unit 5 and the developing unit 10. The sealing member 72 is disposed within a through space 49. When the process cartridge 93 is folded, the sealing member 72 can be relatively simply attached to and detached from the process cartridge 93 by an operation from the outside thereof.

In an exemplary embodiment of the invention, the process cartridge 93 includes the sealing member 72 as a member that is disposed within the through space 49. However, the member disposed within the through space 49 is not limited to the sealing member 72, and may be other members or components.

Figure 21:
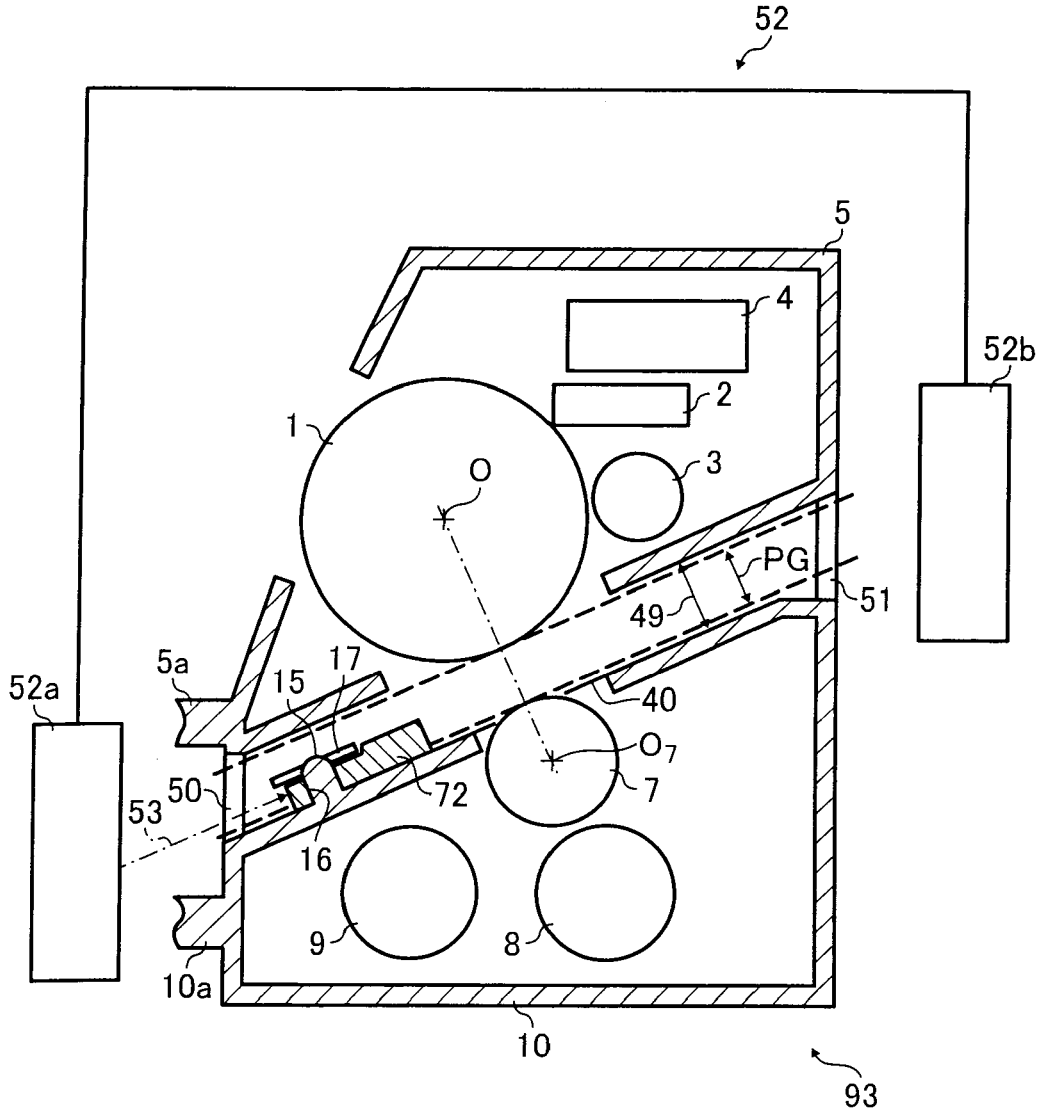
FIG. 21 is a sectional view illustrating a folded state of a process cartridge according to another exemplary embodiment of the present invention.
Figure 22:
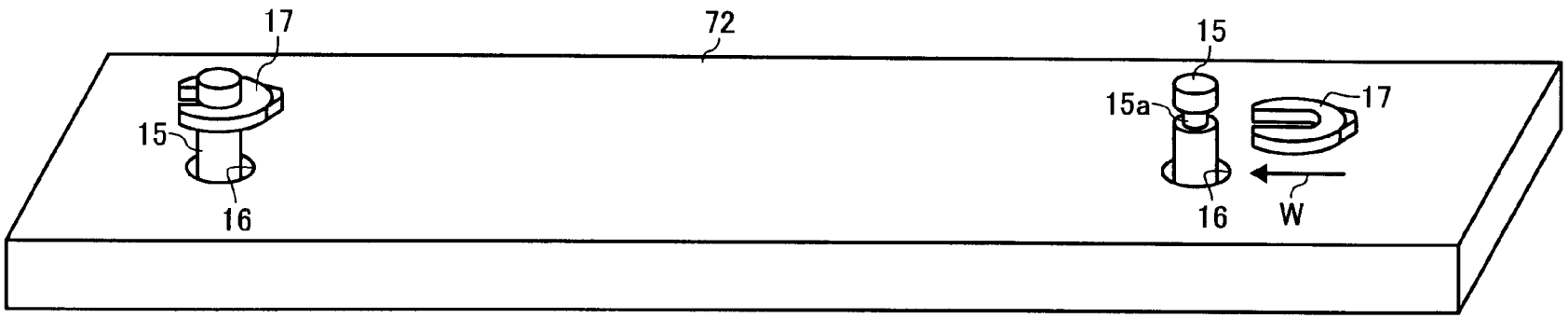
FIG. 22 is an explanatory view illustrating a method of fixing a sealing member in the process cartridge of FIG. 17.

As illustrated in FIGS. 21 and 22, the sealing member 72 has a size capable of going through an opening 50. The sealing member 72 is partially or wholly disposed within the through space 49 in the process cartridge 93. Light 53, which is irradiated from an irradiation aperture 52*a*, is partially or wholly shielded by the sealing member 72. Therefore, a process gap PG between outer surfaces of a photoconductor drum 1 and a developing roller 7 might not be properly measured.

Hence, according to an exemplary embodiment of the present invention, the sealing member 72 is provided with engaging holes 16, while the developing unit 10 is provided with protrusions 15. The protrusions 15 are inserted into the corresponding engaging holes 16.

Each of the protrusions 15 has a groove 15*a*. Stoppers 17, such as molded E-shape rings, are engaged with the corresponding grooves 15*a* in a direction indicated by an arrow W in FIG. 22.

Thus, the movement of the sealing member 72 can be regulated, and the stoppers 17 can be detached from the groove 15*a* by hand or tool.

When detaching the sealing member 72, first, the stoppers 17 are disengaged from the grooves 15*a* by hand or tool. At this time, an operator can perform the disengaging operation from the outside of the process cartridge 93.

Then the sealing member 72 is pulled out from the protrusions 15 and is taken out of the process cartridge 60 via the opening 50. Thereby the object shielding the light 53 is taken out of the through space 49. Thus, the process gap PG can be measured by a measuring device 52.

When the sealing member 72 remains within the through space 49, an operator may need some effort for a check, replacement, or positional adjustment operation of the sealing member 72. Hence, according to an exemplary embodiment of the present invention, the protrusions 15 are provided on the developing unit 10, while the engaging holes 16 are formed on the sealing member 72.

Further, the stoppers 17 are configured to be engageable with and disengageable from the grooves 15*a* of the protrusions 15. Thus, the process cartridge 93 can facilitate replacement and adjustment operations of the sealing member 72.

Thus, even if the sealing member 72 is provided within the through space 49, the sealing member 72 can be removed from the through space 49 and the processing gap PG can be optically measured by the measuring device 52.

Further, a measurement operation of the process gap PG on a manufacturing line can be facilitated, which may result in a more effective quality assurance of the process cartridge 93. Furthermore, even if a failure occurs in the process cartridge 93 on the manufacturing line, the failure may be analyzed without disassembling the process cartridge 93.

The process cartridge 93 according to an exemplary embodiment of the present invention may further include transparent boards 54 and 55 as described in the process cartridge 92.

Next, a process cartridge 94 according to another exemplary embodiment of the present invention is described with reference to FIGS. 23 and 24.

Figure 23:
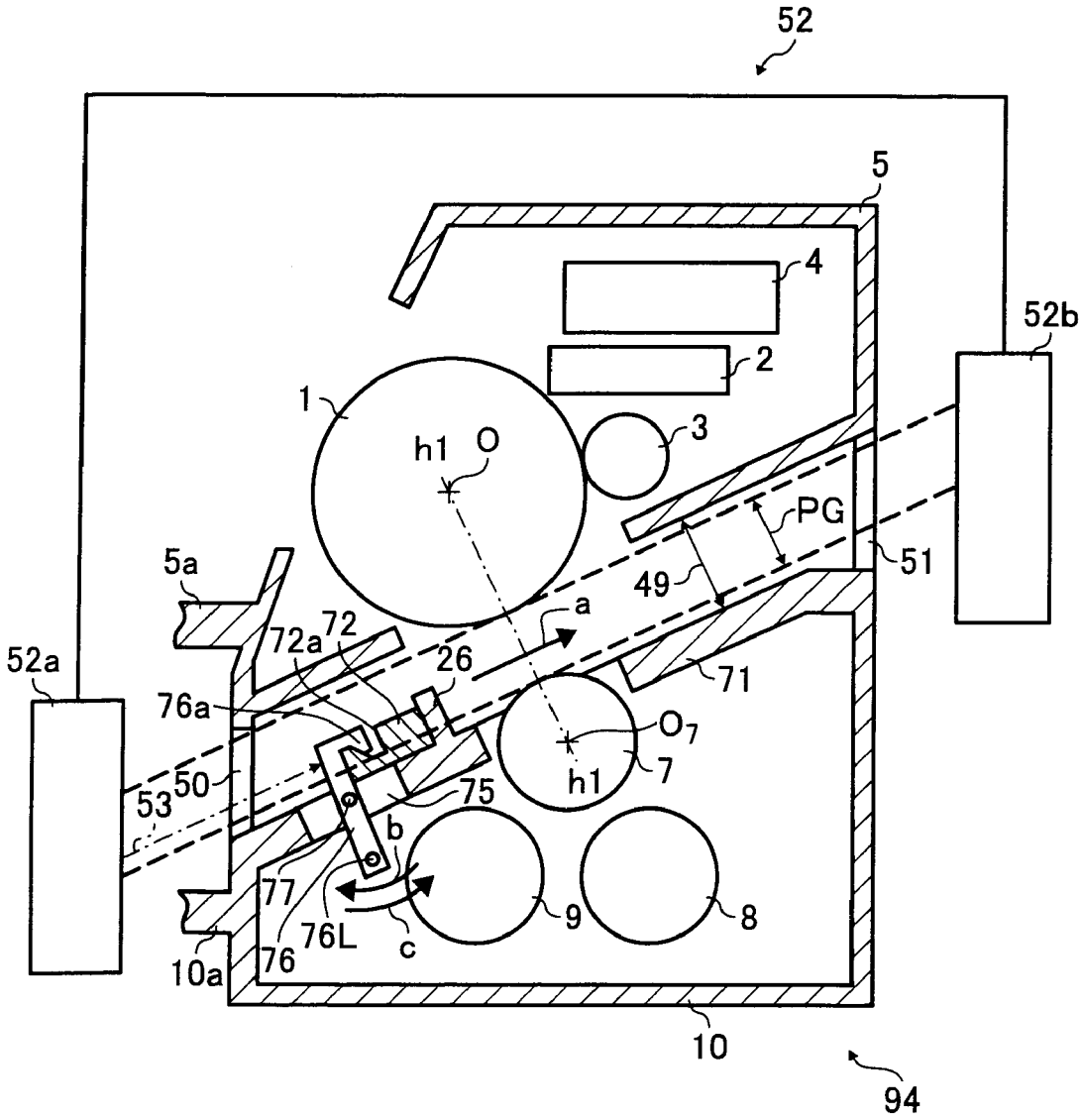
FIG. 23 is a sectional view illustrating a folded state of a process cartridge according to another exemplary embodiment of the present invention.

FIG. 23 is a sectional view illustrating a folded state of the process cartridge 94.

Figure 24:
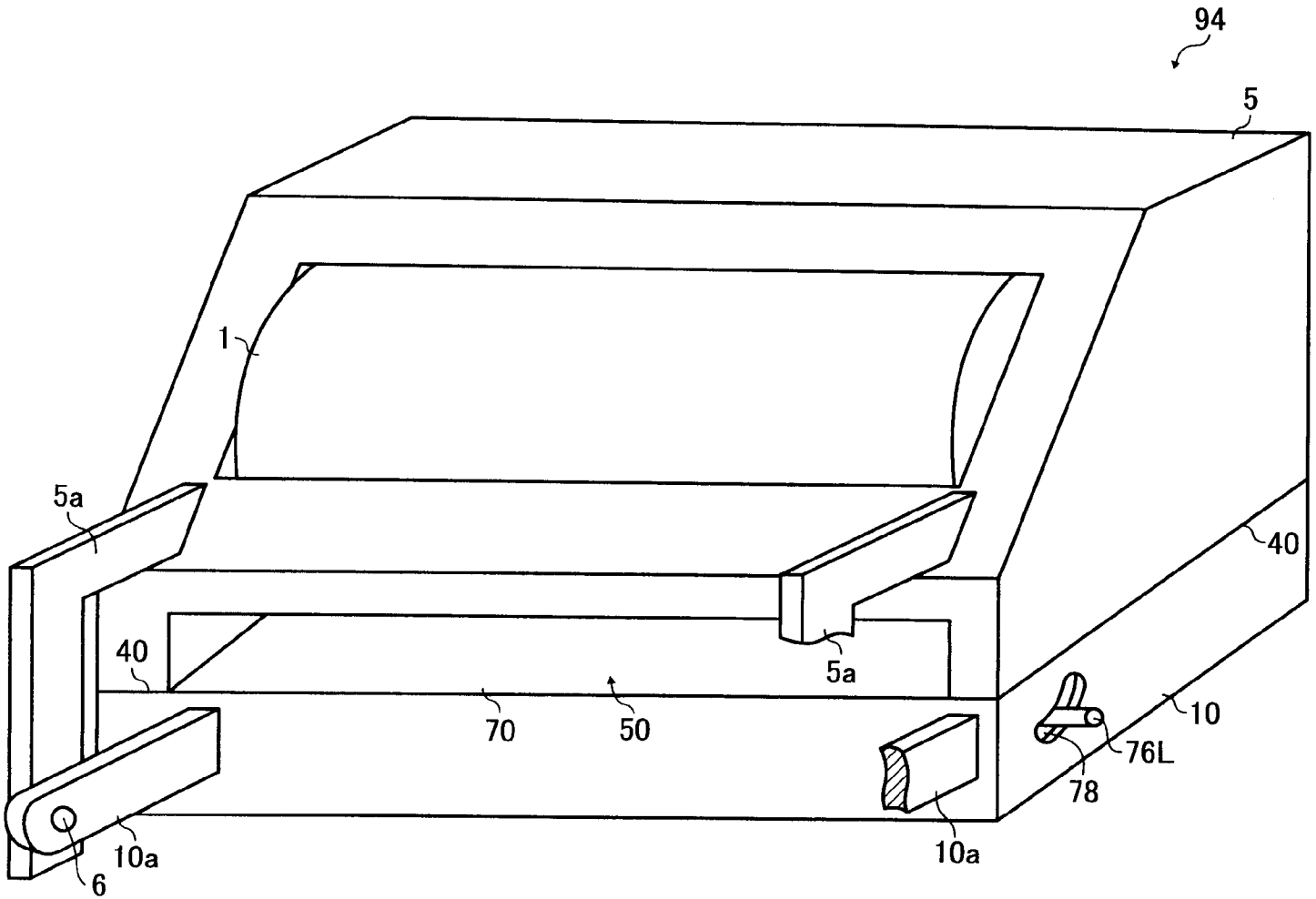
FIG. 24 is a perspective view illustrating a folded state of the process cartridge of FIG. 23.

FIG. 24 is a perspective view illustrating a folded state of the process cartridge 94 of FIG. 23.

The process cartridge 94 has substantially identical configurations to the process cartridge 91 of FIGS. 17 and 18. The identical components or members are represented by identical numeral and letter codes of FIGS. 17 and 18, and repeated descriptions thereof are omitted.

As illustrated in FIG. 23, a sealing member 72 has a size capable of going through an opening 50. The sealing member 72 is partially or wholly disposed within the through space 49 in the process cartridge 94. The position of the sealing member 72 is regulated by stoppers 26 with respect to a direction, as indicated by an arrow "a", from the opening 50 toward the through space 49. The stoppers 26 are provided on the developer unit 10.

As illustrated in FIG. 23, the sealing member 72 is mounted on an upper surface of the developing unit 10. In such a configuration, light 53, which is irradiated from an irradiation aperture 52*a*, is partially or wholly shielded by the sealing member 72. Therefore, a process gap PG between outer surfaces of a photoconductor drum 1 and a developing roller 7 might not be properly measured.

Hence, according to an exemplary embodiment of the present invention, elongate holes 75 are formed at lateral sides of a top board 71 of the developing unit 10. Levers 76 are disposed so as to pass through the corresponding elongate holes 75. Each lever 76 is fitted with the upper board 71 by a shaft 77 at a mid point thereof. Thus each lever 76 is configured so as to be swingable around the shaft 77.

From the lower end of each lever 76, a lever shaft 76L extends in a direction substantially perpendicular to a side wall of the developing unit 10.

As illustrated in FIG. 24, the side wall of the developing unit 10 has an elongate hole 78. Similarly the opposite side wall has another elongate hole 78.

Each elongate hole 78 is formed in an arc shape around the shaft 77. From the elongate hole 78, one end of each lever shaft 76L extends toward the outside of the process cartridge 94. Thus an operator can operate the end of each lever shaft 76L.

An upper portion of each lever 76 is formed in an L shape. The end of the upper portion is configured as a hook portion 76*a*. The sealing member 72 has recesses 72*a* for engaging with the hook portions 76*a*. As described above, each lever 76 is configured so as to be swingable around the shaft 77.

When each lever shaft 76L is positioned at a rear end of the elongate hole 78, the hook portion 76*a* is detached from the recess 72*a*. On the other hand, when the lever shaft 76L is positioned at a front end of the elongate hole 78, the hook portion 76*a* is inserted into the recess 72*a* to fix the sealing member 72. Each lever shaft 76L is releasably held by a holding member (not illustrated) at respective positions in the front and rear ends of the elongate hole 78.

As described above, for example, when each lever 76 swings in a direction indicated by an arrow "b" in FIG. 24, the hook portion 76*a* thereof is inserted into the recess 72*a* of the sealing member 72, thereby stopping the swinging of the lever 76. Thus the sealing member 72 is fixedly pressed against each stopper 26. At this time, if the recess 72*a* and the hook portion 76*a* are firmly engaged with each other, the lever 76 and the sealing member 72 can be held together in a fixed state.

When the lever 76 and the sealing member 72 are fixed each other, the fixed state can be released by applying an external force to the lever 76 in a direction indicated by an arrow "c" in FIG. 23.

The sealing member 72 is moved toward the opening 50 by further rotating the lever 76 in the direction indicated by the arrow "c". Then the sealing member 72 can be taken from the process cartridge 94 to the outside.

Thus, even when the process cartridge 94 remains folded, attaching and detaching operations of the sealing member 72 can be effectively performed. Similarly, when the process cartridge 94 is unfolded, the attaching and detaching operations of the sealing member 72 can also be facilitated.

By removing the sealing member 72 as described above, the object shielding the light 53 is removed from the through space 49. Thus the processing gap PG can be measured by a measuring device 52.

Therefore, according to the present example embodiment, even if the sealing member 72 is disposed within the through space 49, the sealing member 72 can be taken out of the process cartridge 94 by an operation from the outside thereof. Thus, the process cartridge 94 can optically measure the processing gap PG by the measuring device 52.

Next, a process cartridge 95 according to another exemplary embodiment of the present invention is described with reference to FIGS. 25 to 27.

Figure 25:
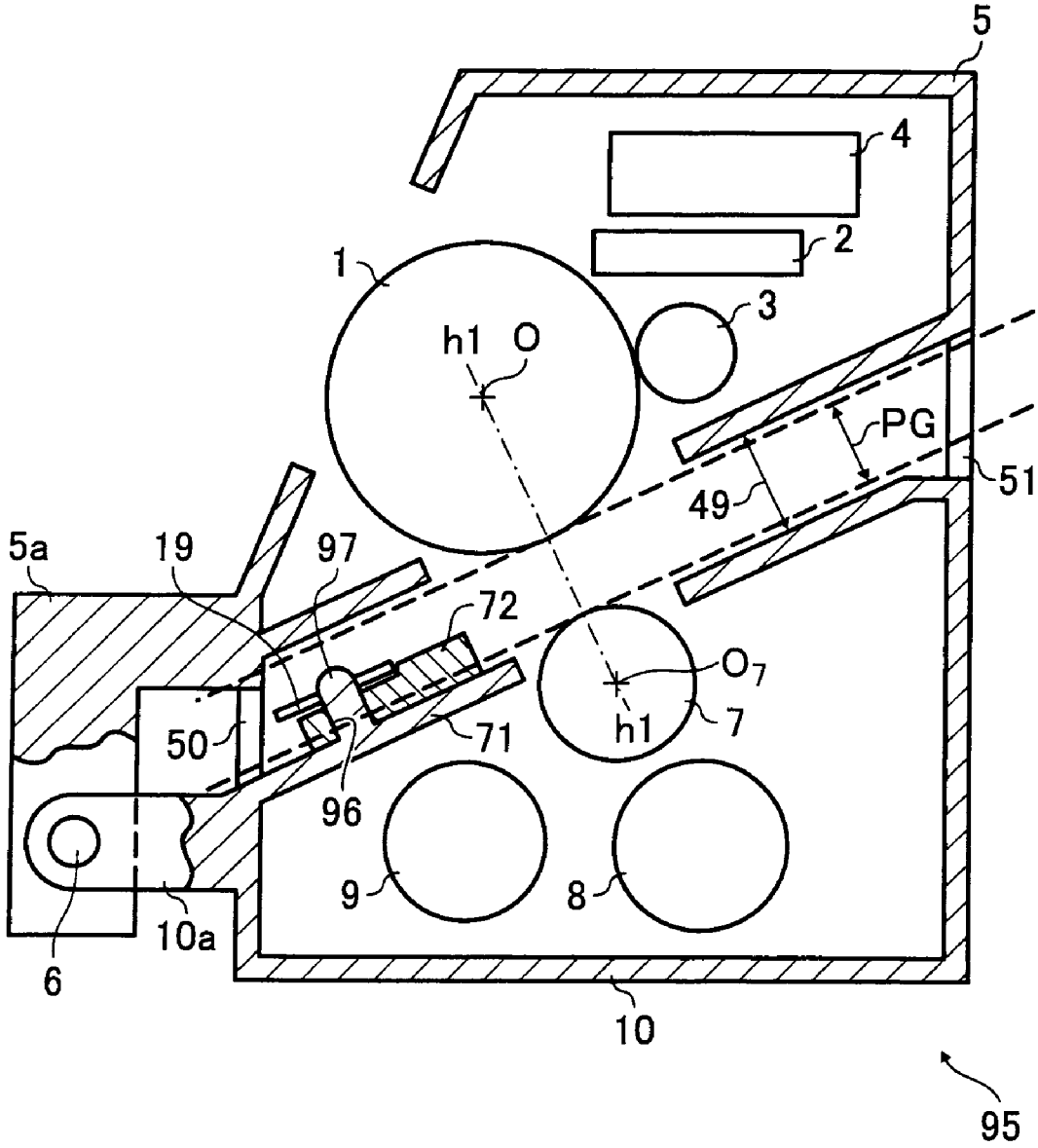
FIG. 25 is a sectional view illustrating a folded state of a process cartridge according to another exemplary embodiment of the present invention.

FIG. 25 is a sectional view illustrating a folded state of the process cartridge 95.

Figure 26:
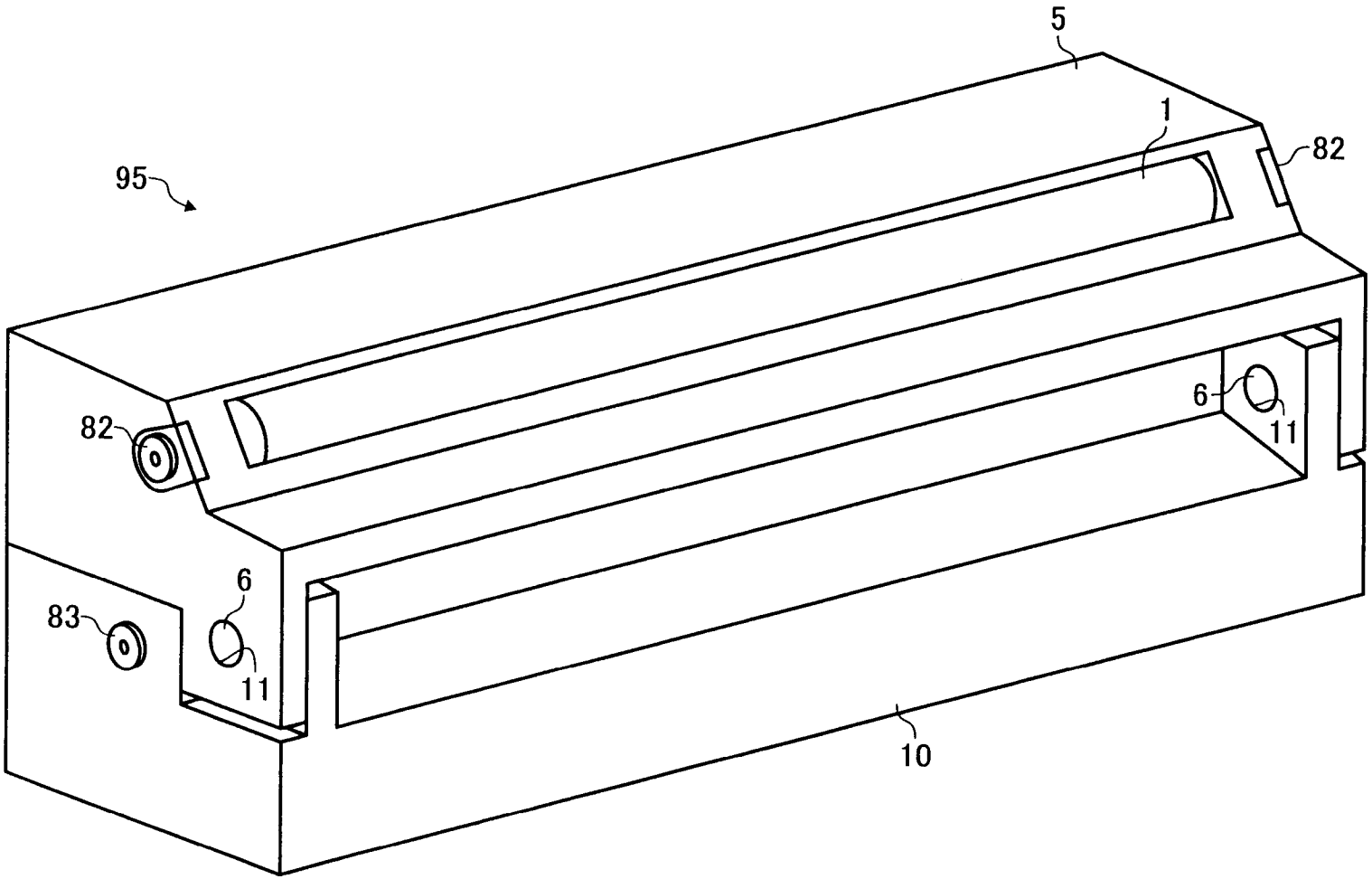
FIG. 26 is a perspective view illustrating a folded state of the process cartridge of FIG. 25.

FIG. 26 is a perspective view illustrating a folded state of the process cartridge 95 of FIG. 25.

FIG. 27 is a sectional view illustrating a unfolded state of the process cartridge 95.

The process cartridge 95 has substantially identical configurations to the process cartridge 91 of FIGS. 17 and 18. The identical components or members are represented by identical numeral and letter codes to FIGS. 17 and 18, and repeated descriptions thereof are omitted.

As illustrated in FIG. 26, a drum unit 5 is provided with bearings 82 at side surfaces thereof. The bearings 82 hold a photoconductor drum 1 in the drum unit 5. Thereby, the photoconductor drum 1 is smoothly rotatable.

A developing unit 10 is provided with bearings 83 at side surfaces thereof. The bearings 83 hold a developing roller 7 in the developing unit 10. Thereby the developing roller 7 is smoothly rotatable in the developing unit 10.

Thus, similar to the process cartridges 91 to 94 according to the above-described example embodiments, the process cartridge 95 can suppress an accidental drop or unintentional positional shift of the photoconductor drum 1 and the developing roller 7 during a pivoting operation of the drum unit 5 and the developing unit 10.

When the process cartridge 95 is mounted on an image forming apparatus, the process cartridge 95 is folded as illustrated in FIGS. 25 and 26. Thus, the photoconductor drum 1 and the developing roller 7 are operably positioned. After the process cartridge 95 is withdrawn from the image forming apparatus for component replacement, the process cartridge 95 is unfolded as illustrated in FIG. 27. Thus, the photoconductor drum 1 and the developing roller 7 are positioned away from each other so as to be suitable for component replacement.

FIG. 27 is a sectional view illustrating a folded state of the process cartridge 95. In the unfolded state as illustrated in FIG. 25, a sealing member 72 is partially or wholly positioned within a through space 49. The sealing member 72 is provided with engaging holes 96. The developing unit 10 is provided with a top board 71 having protrusions 97.

The protrusions 97 are inserted into the corresponding engaging holes 96. Further, stoppers 19, such as molded E-shape rings, are engaged into grooves, which are formed on the protrusions 97 to fix the sealing member 72. The stoppers 19 can be disengaged from the grooves by hand or tool.

After the sealing member 72 is taken out of the process cartridge 95, the process cartridge 95 is unfolded as illustrated in FIG. 27. The stoppers 19 are disengaged from the protrusions 97 by hand or tool from the outside of the process cartridge 95. Then the sealing member 72 is pulled out of the protrusions 97. Thus, the sealing member 72 can be taken out of the process cartridge 95.

After the detachment of the sealing member 72, the process cartridge 95 is folded as illustrated in FIG. 25. At this time, the sealing member 72 has been removed from the through space 49. Therefore a process gap PG, which is a distance between outer surfaces of a photoconductor drum 1 and a developing roller 7, can be measured by a measuring device 52 as described in the above exemplary embodiments.

According to an exemplary embodiment of the present invention, the process cartridge 95 is foldably and unfoldably configured by pivoting the drum unit 5 and the developing unit 10 relative to each other around a common shaft. Therefore the process cartridge 95 is switchable between the folded and unfolded states.

In the unfolded state as illustrated in FIG. 27, the sealing member 72 can be attached to and detached from the through space 49. Further operations such as check, positional adjustment, and component replacement can be performed for the sealing member 72 in the through space 49.

Thus components, such as the drum unit 5 and the developing unit 10, which are conventionally discarded as a whole after use, can be repeatedly reused. Therefore the manufacturing cost and the environmental load of the process cartridge 95 can be reduced.

Next, an image forming apparatus 100 according to an exemplary embodiment of the present invention is described with reference to FIG. 28.

Figure 28:
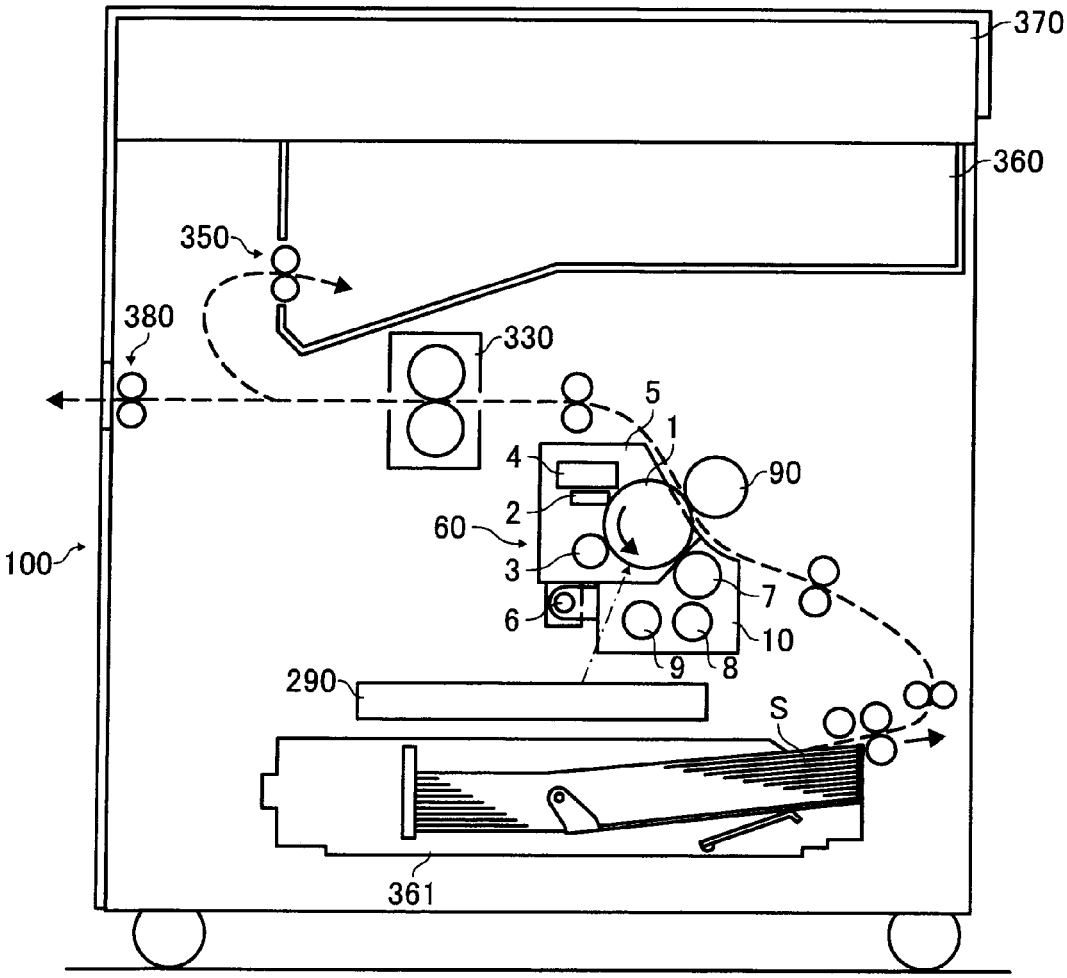
FIG. 28 is a schematic view illustrating a configuration of an image forming apparatus according to an exemplary embodiment of the present invention.

For example, the above-described process cartridge 60 can be mounted on the image forming apparatus 100 as illustrated in FIG. 28. In an exemplary embodiment of the present invention, only the process cartridge 60 is described as a process cartridge used in the image forming apparatus 100. However, any of the other process cartridges 61 to 64, 70, 80, 91 to 95 as described above can be used in the image forming apparatus 100.

As illustrated in FIG. 28, the image forming apparatus 100 is provided with an image scanner 370 at the uppermost portion thereof. Under the image scanner 370 are disposed in turn an internal output tray 360, a fixing device 330, an image forming section including any of the process cartridge 60, a sheet feeder 361 including a sheet tray for storing sheet media S.

The process cartridge 60 is detachably mounted on the image forming apparatus 100. Under the process cartridge 60 is disposed an optical writing device 290. The charger 3 charges the surface of the photoconductor drum 1. The optical writing device 290 irradiates a light beam on the charged surface of the photoconductor drum 1 so that a desired image is appropriately formed on a sheet medium S. Thus, an electrostatically latent image is carried on the surface of the photoconductor drum 1.

The latent image is visualized with developer including toner while passing through a nip between the photoconductor drum 1 and the developing roller 7. The visualized toner image on the photoconductor drum 1 is transferred on the sheet medium S. The sheet medium S is conveyed along a conveyance path, which is indicated by a dashed line starting from the sheet feeder 361.

After the transfer process, the sheet medium S is conveyed to the fixing device 330 along the conveyance path by the rotation of conveying rollers. The toner image on the sheet medium S is fixed while passing through a nip region of the fixing device 330.

After the sheet medium S exits the fixing device 330, the conveyance path of the sheet medium S is branched into two paths by a branching mechanism.

For the one path, the sheet medium S is inversely conveyed, and is ejected from a pair of ejecting rollers 350 to the internal output tray 360.

For the other path, the sheet medium S is conveyed through a pair of ejecting rollers 380 to a post-processing device (not illustrated).

As described above, the image forming apparatus 100 is provided with the process cartridge 60 including the photoconductor drum 1 and the developing roller 7. The process cartridge 60 is detachably mounted on the image forming apparatus 100. The developing roller 7 visualizes an electrostatic latent image formed on the photoconductor drum 1 with developer including toner. The visualized toner image is transferred and fixed on a sheet medium S to obtain an desired image.

Use of the process cartridge 60 for the image forming apparatus 100 can facilitate maintenance and inspecting operations of components of the process cartridge 60.

Next, a process cartridge 96 according to another exemplary embodiment of the present invention is described with reference to FIG. 29. The process cartridge 96 is configured to be disassembled and reassembled.

Figure 29:
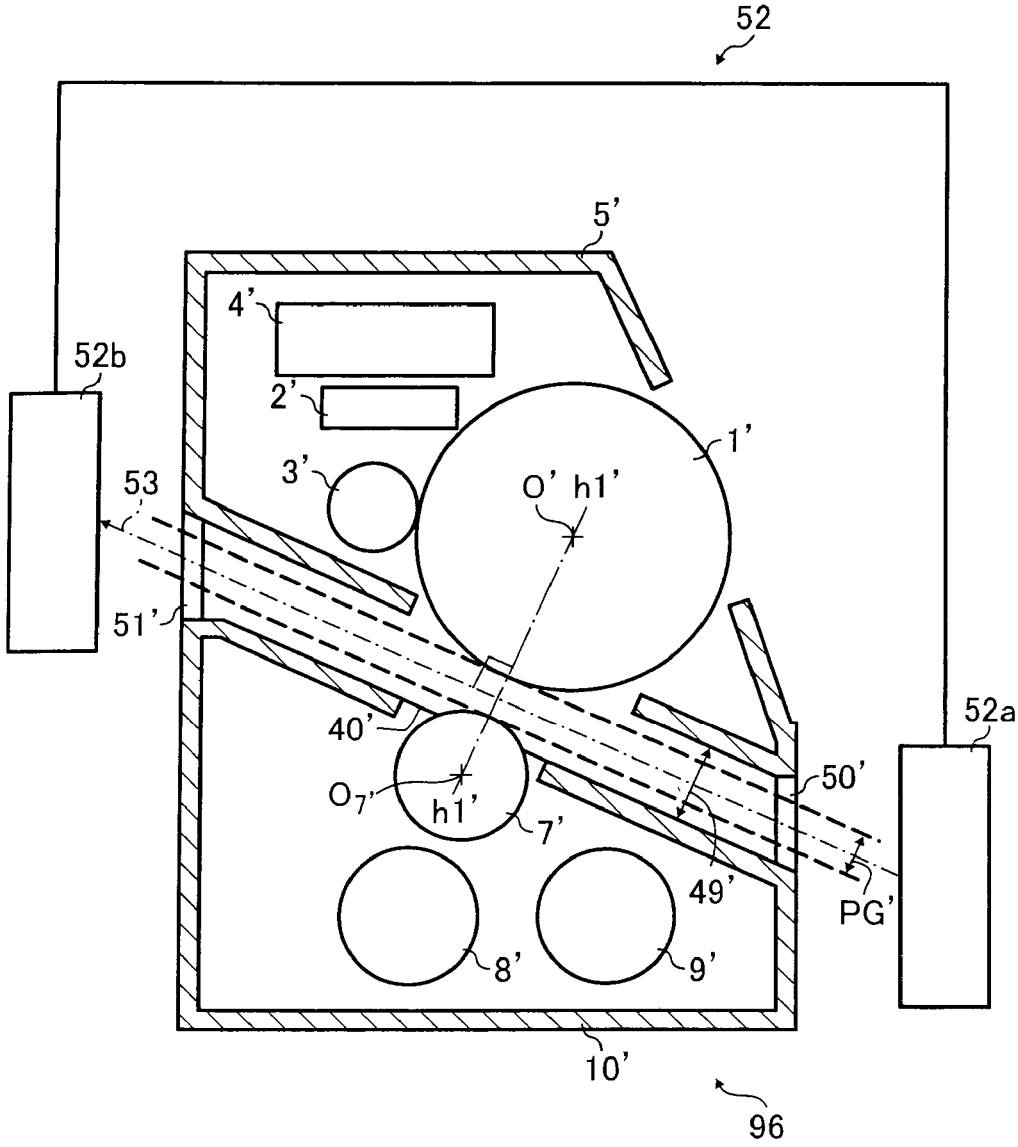
FIG. 29 is a sectional view illustrating an assembled state of a disassemblable process cartridge according to another exemplary embodiment of the present invention.

FIG. 29 is a sectional view illustrating an assembled state of the process cartridge 96. The process cartridge 96 includes a drum unit 5' as a first unit and a developing unit 10' as a second unit. The drum unit 5' and the developing unit 10' also includes a photoconductor drum 1' and a developing roller 7', respectively.

FIG. 29 illustrates an assembled state of the process cartridge 96 where the drum unit 5' and the developing unit 10' are assembled together to integrally form the process cartridge 96.

In the process cartridge 96, two sets of the drum units 5' and the developing units 10' are arranged along a longitudinal direction of the photoconductor drum 1'. The drum unit 5' and the developing unit 10' are configured to be disassembled and assembled. In the assembled state as illustrated in FIG. 29, a through space 49' is formed so as to pass through between the drum unit 5' and the developing unit 10'. The through space 49' is substantially identical in configuration and function with the through space 49 as described above with reference to FIG. 17.

When the process cartridge 96 is disassembled, the drum unit 5' and the developing unit 10' can be separated from each other unlike the drum unit 5 and the developing unit 10 as illustrated in FIG. 3. The process cartridge 96 does not include support members, such as the support members 5*a* and 10*a* of FIG. 17, for foldably and unfoldably coupling the drum unit 5' and the developing unit 10'. Therefore in the disassembled state, the drum unit 5' and the developing unit 10' are separated from each other unlike the above-described exemplary embodiments.

For the disassembled state, for example, if the process cartridge 96 is configured so that the drum unit 5' is disposed on the developing unit 10', an upper portion of the drum unit 5' is open to the outside of the process cartridge 96. Such a configuration can facilitate replacement and maintenance operations of the photoconductor drum 1'.

Alternatively, if the process cartridge 96 is configured so that an upper portion of the developing unit 10' is open to the outside of the process cartridge 96. Such a configuration can facilitate replacement and maintenance operations of a developer transporter 8' and a toner supplying agitator 9'.

In an exemplary embodiment of the present invention, an engaging member or a fastening member, such as a screw, may be used for positioning the drum unit 5' and the developing unit 10' at the assembly thereof. An interface line 40' of FIG. 29 represents an interface formed between the drum unit 5' and the developing unit 10' after the assembly thereof.

As illustrated in FIG. 29, the drum unit 5' includes a photoconductor cleaner 2', a charger 3', and a waste toner container 4' besides the photoconductor drum 1'. The developing unit 10' includes the developer transporter 8' and the toner supplying agitator 9' besides the developing roller 7'.

A central axis O' of the photoconductor drum 1' is disposed in parallel with a central axis O7' of the developing roller 7'. When the process cartridge 96 is assembled and folded, the through space 49' is formed along a normal line direction of a virtual plane h1'-h1 including both the central axes O' and O7'. The through space 49' also passes through between the drum unit 5' and the developing unit 10' so as to include a processing gap PG'. The processing gap PG' is a distance between the outer surfaces of the photoconductor drum 1 and the developing roller 7.

The process cartridge 96 is provided with openings 50' and 51' on side portions of the drum unit 5'. The through space 49' passes through the process cartridge 96 via the openings 50' and 51'.

When measuring the processing gap PG', a measuring device 52 is positioned outside the process cartridge 96, which is in the assembled state. The measuring device 52 includes an irradiation aperture 52*a* from which light is irradiated for measuring the processing gap PG. The measuring device 52 also includes a sensor 52*b* for receiving the light irradiated from the irradiation aperture 52*a*.

The irradiation aperture 52*a* is positioned outside the opening 50', while the sensor 52*b* is positioned outside the opening 51'. The irradiation aperture 52*a* faces the sensor 52*b* via the through space 49'. Light 53, which is irradiated from the irradiation aperture 52*a*, sequentially goes through the opening 50', the processing gap PG', and the opening 51'. Then the sensor 52*b* detects the light 53 and determines the width of the processing gap PG'.

Currently, many image forming sections of image forming apparatuses are integrally configured as compact-size process cartridges to facilitate maintenance and replacement operations thereof. In such a process cartridge, the width of the processing gap PG' between outer surfaces of a photoconductor drum and a developing roller has some effect on the quality of an image formed on a recording medium. Therefore the processing gap PG' is preferably adjustable to obtain a desired image quality.

However, a conventional process cartridge may need to be disassembled in order to remeasure the width of the processing gap PG' after the assembly thereof.

Alternatively, for another conventional process cartridge, the processing gap PG' is measured by detecting a pressure applied from a contact terminal. In this case, a photoconductor drum may be replaced with a specialized drum for measurement. Therefore, such a conventional process cartridge may need some time and effort in the measurement of the processing gap PG'. Additionally, the processing gap PG' is not measured for the photoconductor drum actually used in an image forming apparatus.

Hence, according to an example embodiment of the present invention, the measuring device 52 measures the processing gap PG' by transmitting the light 53 after the assembly of the process cartridge 96. As described above, the process cartridge 96 is provided with the through space 49' including the processing gap PG'. The through space 49' passes through between the drum unit 5' and the developing unit 10' along the normal line direction of the virtual plane h1'-h1', which includes the central axis O' of the photoconductor drum 1' and the central axis $O_7$' of the developing roller 7'.

The measuring device 52 transmits the light 53 from the outside of the through space 49, and therefore the processing gap PG' can be measured without disassembling the process cartridge 91.

Thus, the measurement of the processing gap PG' on a manufacturing line can be facilitated, resulting in more effective quality assurance. Further, even if a failure occurs in the process cartridge 96 on the manufacturing line, the failure may be analyzed without disassembling the process cartridge 96. In particular, such a configuration of the process cartridge 96, in which two independent units are assembled together, is advantageous in that disassembly and assembly operations are not necessarily needed for the measurement of the processing gap PG' or the failure analysis as described above.

For example, for the process cartridge 91 as illustrated in FIG. 7, the drum unit 5 and the developing unit 10 are coupled with each other. On the other hand, for the process cartridge 96 as illustrated in FIG. 29, the drum unit 5' and the developing unit 10' are not coupled with each other. The two units are assembled to integrally form the process cartridge 96.

The process cartridge 91 and the process cartridge 96 are different in whether or not the two units are coupled, while are substantially identical in the configuration of the through space.

Any one configuration of the process cartridges 92 to 94 may be applied to the process cartridge 96 as illustrated in FIG. 29.

For example, in accordance with the process cartridge 92, the process cartridge 96 may include transparent boards 54 and 55, which are disposed so as to close openings of the through space 49'. Further, transparent boards 54 and 55 may be supported by an outer frame of the process cartridge 96.

Alternatively, in accordance with the process cartridge 93 or 94, a component, which is supported on the process cartridge 96, may be disposed within the through space 49' so as to be attachable to and detachable from the process cartridge 96.

For example, the sealing member 72 may be disposed within the through space 49'. Further, a lever 76 and other associated members may be used for the process cartridge 96. Thereby the sealing member 72 can be attached to and detached from the process cartridge 96 by an operation from the outside of the process cartridge 96.

Moreover any one configuration of the other process cartridges 60 to 64, 70, 80, 90, 91, 95 as described above is applicable to the process cartridge 96 as illustrated in FIG. 29.

Figure 30:
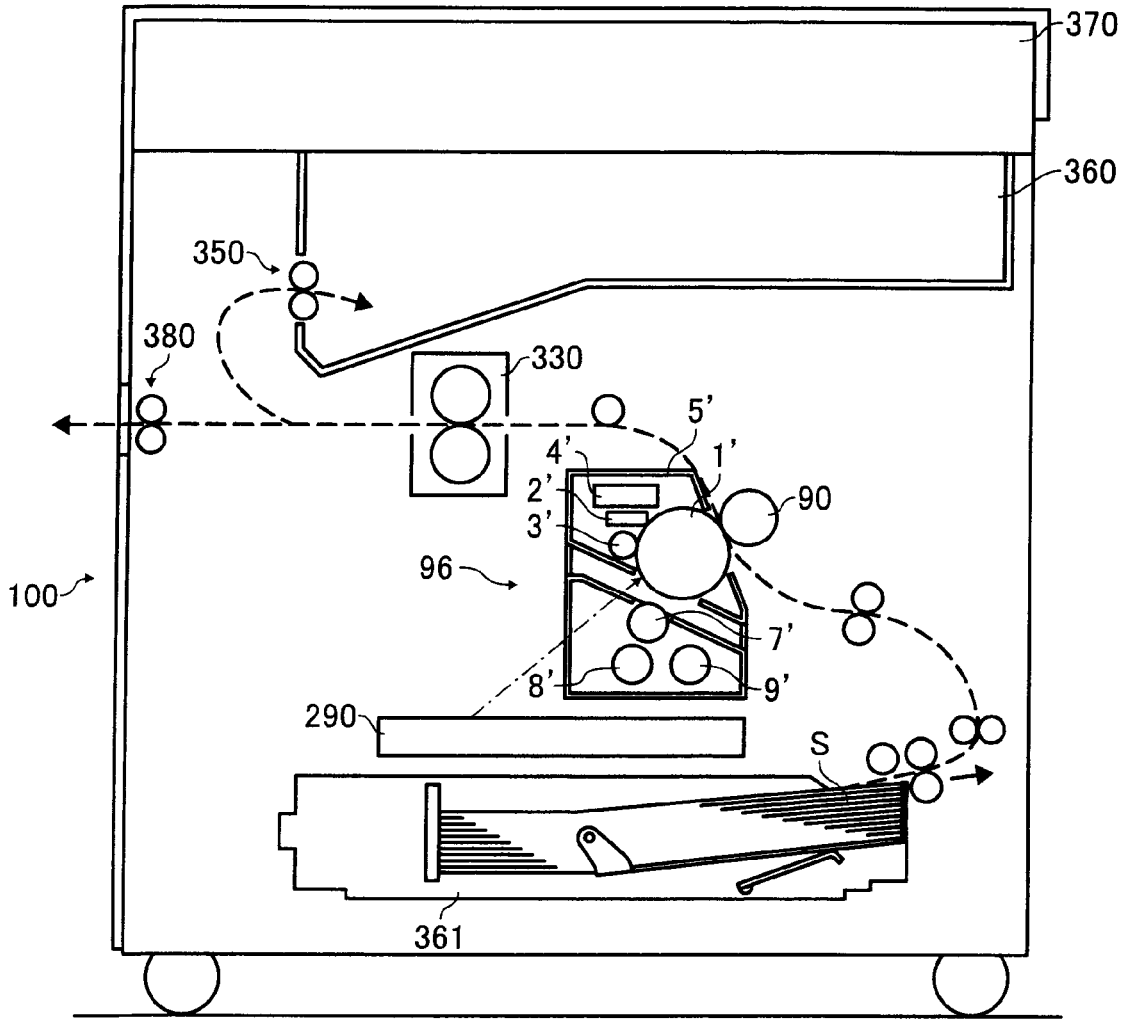
FIG. 30 is a schematic view illustrating a configuration of an image forming apparatus, including the process cartridge of FIG. 29, according to another exemplary embodiment of the present invention.

Furthermore, as illustrated in FIG. 30, the process cartridge 96 of FIG. 29 can be mounted on the image forming apparatus 100 as described with reference to FIG. 28. In FIG. 30, components and members, which are identical in configurations and functions, are represented by identical numeral and letter codes with FIG. 28 or FIG. 29. Therefore, repeated descriptions are omitted.

Numerous additional modifications and variations are possible in light of the above teachings. It is therefore to be understood that within the scope of the appended claims, the disclosure of this patent specification may be practiced otherwise than as specifically described herein.

What is claimed is:

1. A process cartridge for use in an image forming apparatus, comprising:

a first unit including an image carrier;

a second unit including a developer carrier; and a coupling shaft coupling the first unit and the second unit so as to be pivotable relative to each other, wherein a distance between the image carrier and the developer carrier is adjustable by pivoting at least one of the first unit and the second unit via the coupling shaft without releasing the coupling of the first unit and the second unit, and wherein a developing portion of the second unit including the developer carrier is configured as a single unit separately from a remaining portion of the second unit, and the developing portion and the remaining portion of the second unit are coupled so as to be pivotable around a second coupling shaft.

2. The process cartridge according to claim 1, wherein the first unit and the second unit are coupled so as to be pivotable around the coupling shaft, and wherein the image carrier is rotatably supported in the first unit while the developer carrier is rotatably supported in the second unit.

3. The process cartridge according to claim 2, wherein at least one of the first unit and the second unit includes a protrusion for contacting the other of the first or second unit thereof, and wherein the protrusion is configured to keep a fixed distance between the image carrier and the developer carrier to prevent interference between the image carrier and the developer carrier, and is configured to regulate pivoting of the first unit and the second unit.

4. The process cartridge according to claim 2, wherein at least one of the first unit and the second unit includes a stopper and the other one of the first unit and the second unit includes a hole, wherein the stopper is configured to engage with the hole to stop pivoting of the first unit and the second unit, and wherein the stopper and the hole are configured to keep a fixed distance between the image carrier and the developer carrier to prevent interference between the image carrier and the developer carrier.

5. The process cartridge according to claim 4, wherein the stopper has a hook portion configured to regulate pivoting of the first unit and the second unit in a direction of moving the image carrier and the developer carrier away from each other, wherein at least one of the first unit and the second unit includes a biasing member configured to bias the first unit and the second unit in the direction of moving the image carrier and the developer carrier away from each other, and wherein the pivoting of the first unit and the second unit is stopped and held in a position to prevent interference between the image carrier and the developer carrier.

6. The process cartridge according to claim 4, wherein the stopper is configured to fit completely within the hole.

7. The process cartridge according to claim 1, wherein each of the first unit and the second unit has a shape configured for stable placement on a plane when the image carrier and the developer carrier are positioned relatively far away from each other by pivoting at least one of the first unit and the second unit.

8. A process cartridge for use in an image forming apparatus, comprising:

a first unit, and a second unit configured to be assembled with the first unit, wherein, when the first unit and the second unit are assembled to form the process cartridge, a through space is formed between the first unit and the second unit, and a developing portion of the second unit is configured as a single unit separately from a remaining portion of the second unit, and the developing portion and the remaining portion of the second unit are coupled so as to be pivotable around a second coupling shaft.

9. The process cartridge according to claim 8, wherein the first unit and the second unit include an image carrier and a developer carrier, respectively, wherein the image carrier and the developer carrier are arranged so that respective central axes thereof are substantially parallel with each other, and wherein the through space is formed along a normal line direction of a plane including the central axes, and includes a gap formed between the image carrier and the developer carrier.

10. The process cartridge according to claim 9, further comprising:

an outer frame formed of frames of the first unit and the second unit; and a light transparent board, wherein the board is disposed so as to close at least one opening of the through space, and is supported on the outer frame of the process cartridge.

11. The process cartridge according to claim 9, further comprising:

a member disposed in the through space, wherein the member is supported on the process cartridge, and is configured to attach and detach from the process cartridge.

12. The process cartridge according to claim 9, wherein the member is configured to attach and detach from the process cartridge by an operation performed from the outside of the process cartridge.

13. The process cartridge according to claim 8, wherein the first unit and the second unit include an image carrier and a developer carrier, respectively, wherein the first unit and the second unit are pivotably coupled by a coupling shaft so as to pivot relative to each other, and wherein a distance between the image carrier and the developer carrier is adjustable by pivoting at least one of the first unit and the second unit without releasing the coupling of the first unit and the second unit via the coupling shaft.

14. The process cartridge according to claim 13, wherein the first unit and the second unit are coupled so as to be pivotable around the coupling shaft, and wherein the image carrier is rotatably supported in the first unit while the developer carrier is rotatably supported in the second unit.

15. The process cartridge according to claim 14, wherein at least one of the first unit and the second unit includes a protrusion for contacting the other of the first or second unit thereof, and wherein the protrusion is configured to keep a fixed distance between the image carrier and the developer carrier to prevent interference between the image carrier and the developer carrier, and to regulate pivoting of the first unit and the second unit.

16. The process cartridge according to claim 14, wherein at least one of the first unit and the second unit includes a stopper and the other one of the at least one of the first unit and the second unit includes a hole, and wherein the stopper is configured to engage with the hole to stop pivoting of the first unit and the second unit, and to keep a fixed distance to prevent interference between the image carrier and the developer carrier.

17. The process cartridge according to claim 16, wherein the stopper has a hook portion configured to regulate pivoting of the first unit and the second unit in a direction of moving the image carrier and the developer carrier away from each other, wherein at least one of the first unit and the second unit includes a biasing member configured to bias the first unit and the second unit in the direction of moving the image carrier and the developer carrier away from each other, and wherein the pivoting of the first unit and the second unit is stopped and held in position to prevent interference between the image carrier and the developer carrier.

18. The process cartridge according to claim 13, wherein each of the first unit and the second unit has a shape configured for stable placement on a plane when the image carrier and the developer carrier are positioned relatively far away from each other by pivoting at least one of the first unit and the second unit.

19. An image forming apparatus, comprising:

a process cartridge, including a first unit having an image carrier;

a second unit having a developer carrier; and a coupling shaft configured to couple the first unit and the second unit so as to pivot relative to each other, wherein a distance between the image carrier and the developer carrier is adjustable by pivoting at least one of the first unit and the second unit via the coupling shaft without releasing the coupling of the first unit and the second unit, and wherein a developing portion of the second unit including the developer carrier is configured as a single unit separately from a remaining portion of the second unit, and the developing portion and the remaining portion of the second unit are coupled so as to be pivotable around a second coupling shaft.

* * * * *